US011952174B2

(12) United States Patent
Makofsky et al.

(10) Patent No.: US 11,952,174 B2
(45) Date of Patent: Apr. 9, 2024

(54) INSERT FOR A FLAT-SIZED FLEXIBLE ENVELOPE

(71) Applicant: Conformer Products, Inc., Port Washington, NY (US)

(72) Inventors: Robert Makofsky, New York City, NY (US); Murray Rundle, Stouffville (CA); Philip W. Jager, Oakville (CA)

(73) Assignee: CONFORMER EXPANSION PRODUCTS, INC., Port Washington, NY (US)

( * ) Notice: Subject to any disclaimer, the term of this patent is extended or adjusted under 35 U.S.C. 154(b) by 696 days.

(21) Appl. No.: 16/717,391

(22) Filed: Dec. 17, 2019

(65) Prior Publication Data

US 2020/0189797 A1 Jun. 18, 2020

Related U.S. Application Data

(60) Provisional application No. 62/868,326, filed on Jun. 28, 2019, provisional application No. 62/781,399, filed on Dec. 18, 2018.

(51) Int. Cl.
*B65D 27/02* (2006.01)
*B65D 27/08* (2006.01)

(52) U.S. Cl.
CPC ..... *B65D 27/02* (2013.01); *B65D 27/08* (2013.01)

(58) Field of Classification Search
CPC ..... B65D 27/02; B65D 27/08; B65D 27/00; B65D 27/04; B65D 5/5213; B65D 5/48; B65D 5/49
See application file for complete search history.

(56) References Cited

U.S. PATENT DOCUMENTS 2,833,457 A * 5/1958 Tyrseck ..... B65D 5/524 229/164
3,122,299 A * 2/1964 Haas ..... B65D 5/6697 229/125.08
4,240,547 A * 12/1980 Taylor ..... B01L 9/06 220/4.24
5,899,336 A * 5/1999 Kataoka ..... B65D 5/5004 206/592
7,097,042 B2 * 8/2006 Hsu ..... B65D 5/4801 229/120.04
7,731,081 B2 * 6/2010 Liang ..... B65D 5/4608 229/120.13
7,748,527 B2 * 7/2010 Wisecarver ..... B65D 5/5069 206/321
8,887,985 B2 * 11/2014 Laughman ..... B65D 5/542 229/242
9,156,580 B2 * 10/2015 Ladanyi ..... A47G 21/14
(Continued)

*Primary Examiner* — Derek J Battisti
(74) *Attorney, Agent, or Firm* — Francis C. Hand; CARELLA, BYRNE, ET AL

(57) ABSTRACT

A blank is provided for making an insert that satisfies the USPS requirement that a flat-sized mail piece be uniformly thick so that any bumps, protrusions or other irregularities do not cause more than ¼" variance in thickness.

In one embodiment, when folded, the blank forms an insert with spacers about a quadrant that receives a good to be mailed.

In other embodiments, when folded, the blank forms an insert with sleeves into which goods may be slid, or an insert with sleeves with closed ends and into which goods may be inserted into cutouts in the sleeves.

25 Claims, 37 Drawing Sheets

(56) References Cited

U.S. PATENT DOCUMENTS

| | | | | |
|---|---|---|---|---|
| 9,561,878 | B2 * | 2/2017 | Lee | B65D 5/5023 |
| 2007/0140597 | A1 * | 6/2007 | Ozdeger Donovan | B65D 27/08<br>383/14 |
| 2009/0057379 | A1 * | 3/2009 | Schulhof | B65D 5/4208<br>229/75 |
| 2016/0114965 | A1 * | 4/2016 | Huang | B65D 85/30<br>206/472 |
| 2017/0352047 | A1 * | 12/2017 | Coyne, III | G06Q 30/0201 |

* cited by examiner

INSERT FOR A FLAT-SIZED FLEXIBLE ENVELOPE

This is a Non-Provisional Patent Application and claims the benefit of Provisional Patent Application 62/781,399, filed Dec. 18, 2018, and Provisional Patent Application No. 62/868,326, filed Jun. 28, 2019.

This invention relates to an insert for a flat-sized flexible envelope. More particularly, this invention relates to an insert for a flat-sized flexible envelope that conforms to USPS requirements for flexibility and uniform thickness of flat-size pieces.

As is known, various types of envelopes have been constructed for use in mailing items, such as digital video disks (DVDs) and compact disks (CDs). In some cases, the envelopes have been provided with padding, such as described in U.S. Pat. No. 5,662,420, wherein a macerated paper layer is sandwiched between two layers of paper.

In still other cases, as described in U.S. Pat. Nos. 5,544,473 and 7,108,650, it has been known to provide envelopes in which a packing material is inserted to receive an item for shipping. Also, US 2008/0290145 describes various inserts of foam, plastic or corrugated to be used with flexible envelopes.

Still other constructions have been known for use in shipping medical tests specimens wherein a receptacle is provided to receive a test specimen and the receptacle placed in an envelope, such as described in U.S. Pat. No. 5,620,097.

United States Postal Service (USPS) regulations (see 39 CFR Part 111) provide standards for domestic mailing services that set forth minimum flexibility and uniform thickness criteria for flat-sized pieces.

The USPS has established certain requirements that determine if a package is suitable for USPS Flat sorting rates.

Thickness—Flats must be under ¾" thick.

Uniform Thickness—Flat-size mail pieces must be uniformly thick so that any bumps, protrusions, or other irregularities do not cause more than ¼-inch variance in thickness.

Flexibility—Flat-size pieces must be flexible. Mail pieces under 10" long must be able to flex 1" along the long edge and short edge of the package of the package. For mail pieces over 10" long, the mail piece must be able to flex 2" along the long edge and short edge of the package.

Mailers must secure Goods to prevent shifting of more than 2 inches.

Flats must be more than 11½ inches long, or more than 6⅛ inches high, or more than ¼ inch thick Flats may not exceed 15 inches long, or more than 12 inches high, or more than ¾ inch thick.

Accordingly, it is an object of the invention to provide an insert for shipping goods in a package that satisfies the criteria for flat-sized pieces of the USPS.

It is another object of the invention to provide an envelope construction with a flexible insert for shipping items of rigid or non-rigid nature.

It is another object of the invention to be able to mail an item in a manner that qualifies as a flat-sized piece postage in the United States.

Briefly, the invention provides a flexible insert in the form of a tray that occupies the inside of a package in a manner that allows the package to flex with an item to be shipped or mailed within the insert. The item to be received within the insert may be of rigid nature or non-rigid nature.

In one embodiment, the insert has a recess of predetermined shape for receiving an item to be shipped in the package so that the item is prevented from shifting within the package.

In each embodiment, the flexible insert and the item being packaged can be inserted into a pocket of a paper envelope of standard or an expandable construction, as described in U.S. Pat. Nos. 6,227,444 and 9,352,879, and a flap of the envelope can be folded over to close the pocket. In each embodiment, the flexible insert is of a height and width to substantially fill the pocket. Alternatively, the flexible insert and the item may be inserted in a sleeve, plastic bag, shrink-wrapped in plastic, or wrapped with a web of paper or plastic or the like to form the package for mailing purposes. Further, the envelope may be pre-lined with padding to protect fragile items.

In a further embodiment, the flexible insert may be assembled in such a way as to not require supplemental wrapping whereby the flexible insert is self-contained.

The insert is made from a single blank of any suitable material, such a self-supporting plastic foam, corrugated board, paper board or the like. Typically, the recess in the insert is made asymmetrical and to one side of the insert.

When the insert is in place, the package may be flexed or bent in the area occupied by the flexible insert and particularly in a manner that allows the package to conform to the above noted regulations of the USPS.

In one embodiment, the blank for making an insert for an envelope is made of one piece of corrugated board with a main section and three extensions, each of which is foldable to form a spacer on the main section to provide a thickness to the resultant insert.

In this embodiment, the main section has a pair of fold or score lines at right angles to each other to separate the main section into four quadrant components. In addition, one of the quadrant components includes an opening for receiving an item to be shipped or mailed in an envelope or other form of mailer.

A first of the three extensions extends from the quadrant component with the rectangular opening and has three sections that can be disposed in folded over relation to each other and in contact with the main section to form a spacer along one edge of the main section. Fold lines are also provided in the extension to facilitate folding over of the sections of the extension onto each other.

The other two extensions extend from opposite sides of two other quadrant components and are formed with three sections that can be disposed in folded over relation to each other and in contact with the main section to form two spacers, each along a respective edge of the main section.

The three spacers are arranged on the formed insert with one spacer on one side of the insert and two spacers on an opposite side of the insert.

This embodiment is made of one-piece corrugate and the fold lines in the three extensions are spaced apart to accommodate folding over of the three sections of each extension. Specifically, a first fold line is located between and separates an outermost section from a middle section, a first pair of parallel spaced apart fold lines are located between and separates the middle section from an innermost section and a second pair of parallel spaced apart fold lines are located between and separates the innermost section from the respective rectangular component.

In another embodiment of similar construction, the insert has an integral cover that folds over the spacers to present flat surfaces on opposite sides of the insert.

In another embodiment, the blank is made of one piece paperboard with a main section and three extensions, each of which is foldable to form an integrated carton on the resultant insert (tray) that functions as a spacer on the main section to provide a thickness to the insert.

In this embodiment, the main section has a pair of fold or score lines at right angles to each other to separate the main section into four quadrant components. In addition, one of the quadrant components includes an opening for receiving an item to be packaged and shipped as well as tabs that project into the opening for folding out to hold the item in place. For example, for shipping an item of rectangular shape, the opening is of rectangular shape and the tabs are of hemi-spherical shape.

The first extension extends from the quadrant component with the opening and has four sections separated by fold lines or other lines of weakening, such as a line of perforations, that are sized to be assembled into an integrated folding carton along one edge of the main section to function as a spacer for the resultant insert.

The other two extensions extend from opposite sides of two of the other quadrant components and are formed in the same manner as the first extension to form integrated folding cartons along two other edges of the main section.

In addition, one flap extends from the quadrant component having the opening and two flaps extend from the opposite side of the main section with lines of weakening separating each the flap from the main section.

In this embodiment, the next outermost section of each extension has a foldable tab extending laterally from one side thereof and the innermost section of each extension has a like foldable tab extending laterally from one side and a rounded foldable gusset extending laterally from an opposite side.

This embodiment is made of one-piece paperboard and, being thinner than corrugate, the fold lines in the three extensions need not be spaced apart to accommodate folding over of the three sections of each extension to form an insert.

In another embodiment, the insert for an envelope comprises a pair of sections that are integrally hinged together for folding over onto each other. Each section has a frame of paper defining a central opening with a film of transparent material secured to the frame over the opening. In addition, each section has a width of 8¾ inches and a length of 6¾ inches so that a blank for forming the insert may be a standard 8¾ inch by 13 inch size.

Each embodiment of the insert is constructed to ship Goods between ¼ and ¾ thick as a USPS Flat by positioning and holding the Goods in one or more quadrants of a larger package greater than 10" in length and in one or more quadrants of a package less than 10" in length. By positioning goods in either one or more quadrants or halves, the overall package is flexible on both the X and Y axis as desired.

Each embodiment of the insert may also function without an outer envelope, fully enclosing Goods within. For example, the corrugated board or paperboard tray would be constructed to be self-contained with a covering that would hold Goods in place within the cut out/recess. The cut out/recess would then be overlaid by a material holding the Goods in place.

These and other objects and advantages of the invention will become more apparent from the following detailed description taken in conjunction with the accompanying drawings wherein.

Figure 20:
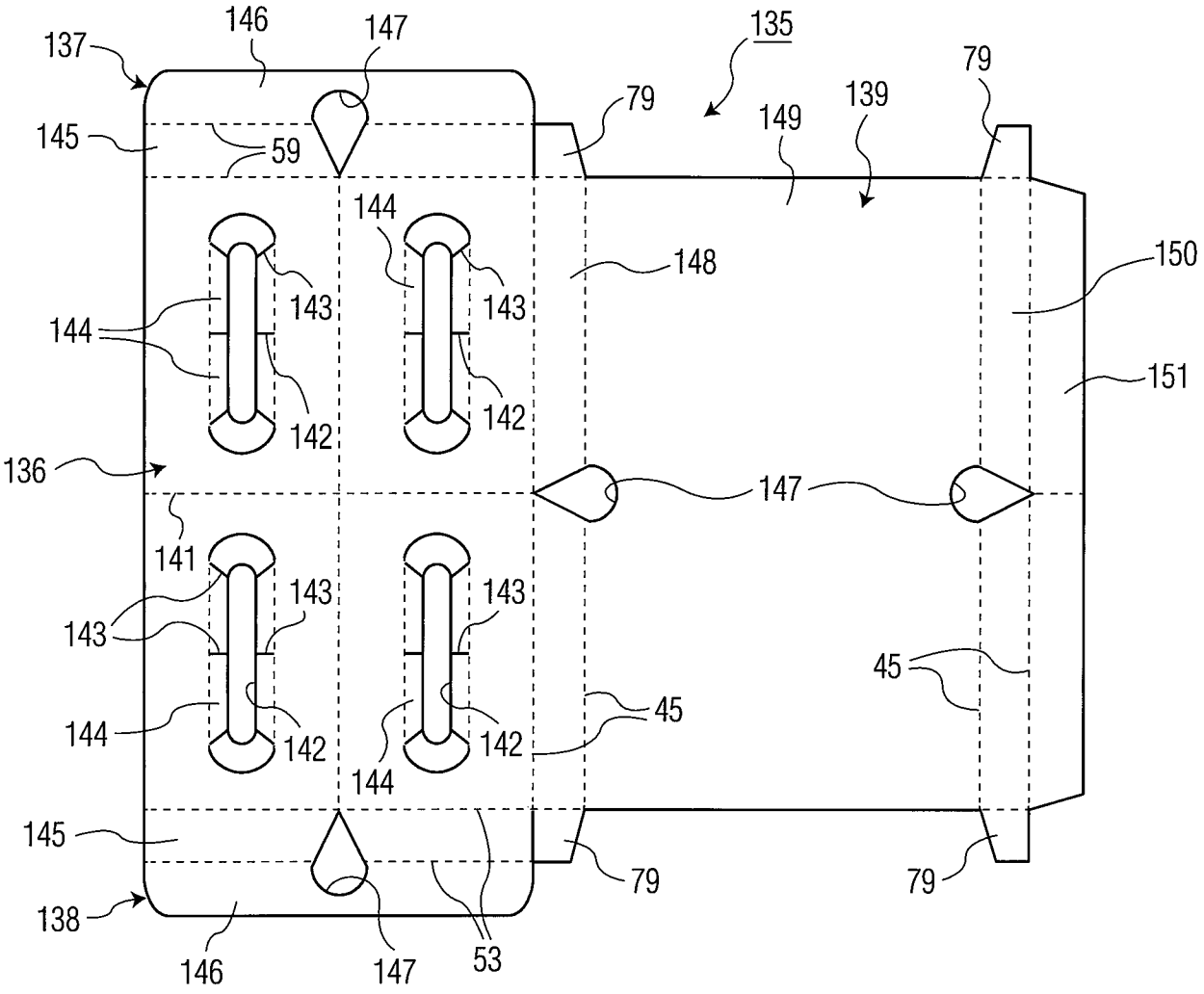
FIG. 20 illustrates a view of a blank for making a further modified insert.
Figure 21:
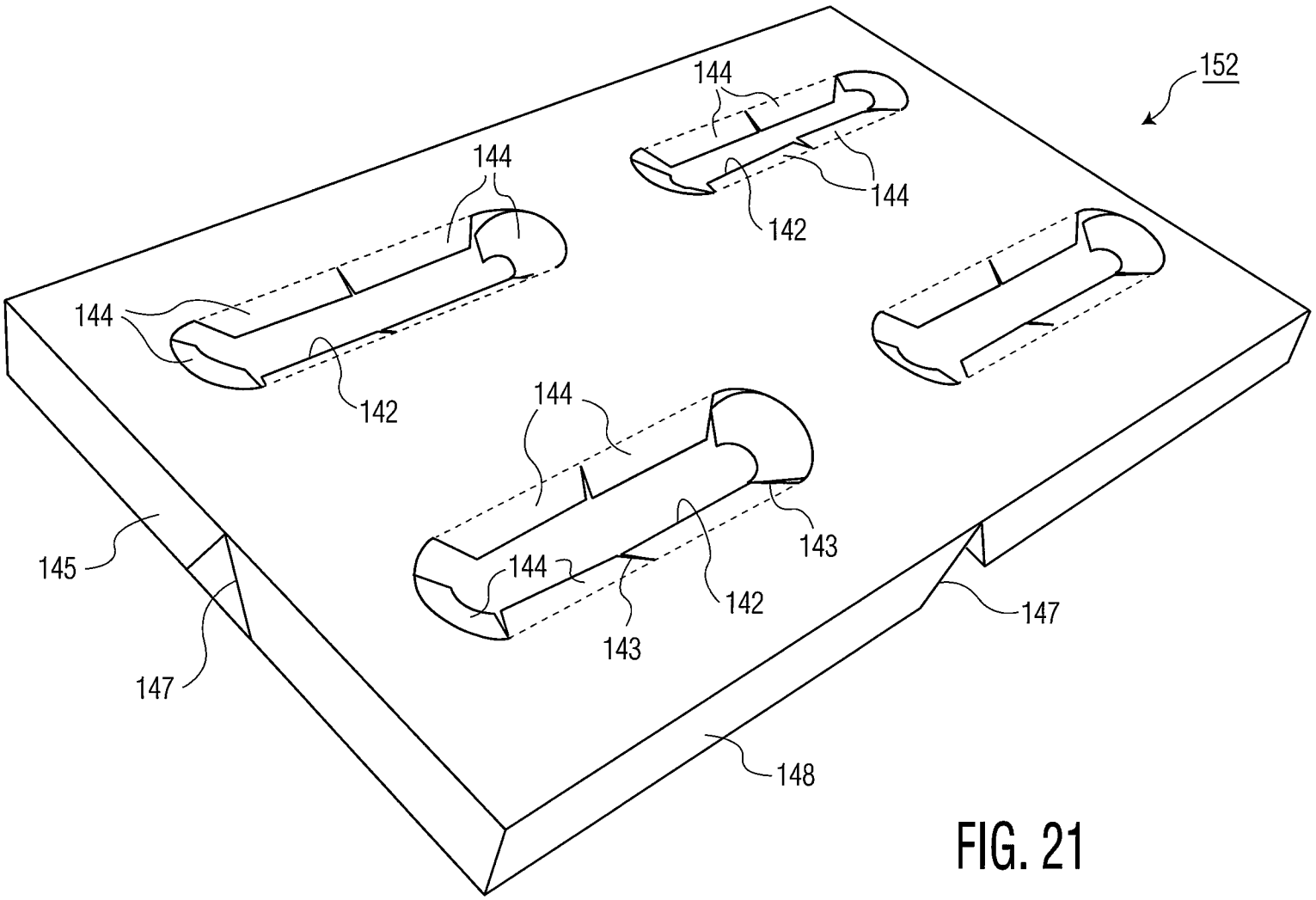
Figure 22:
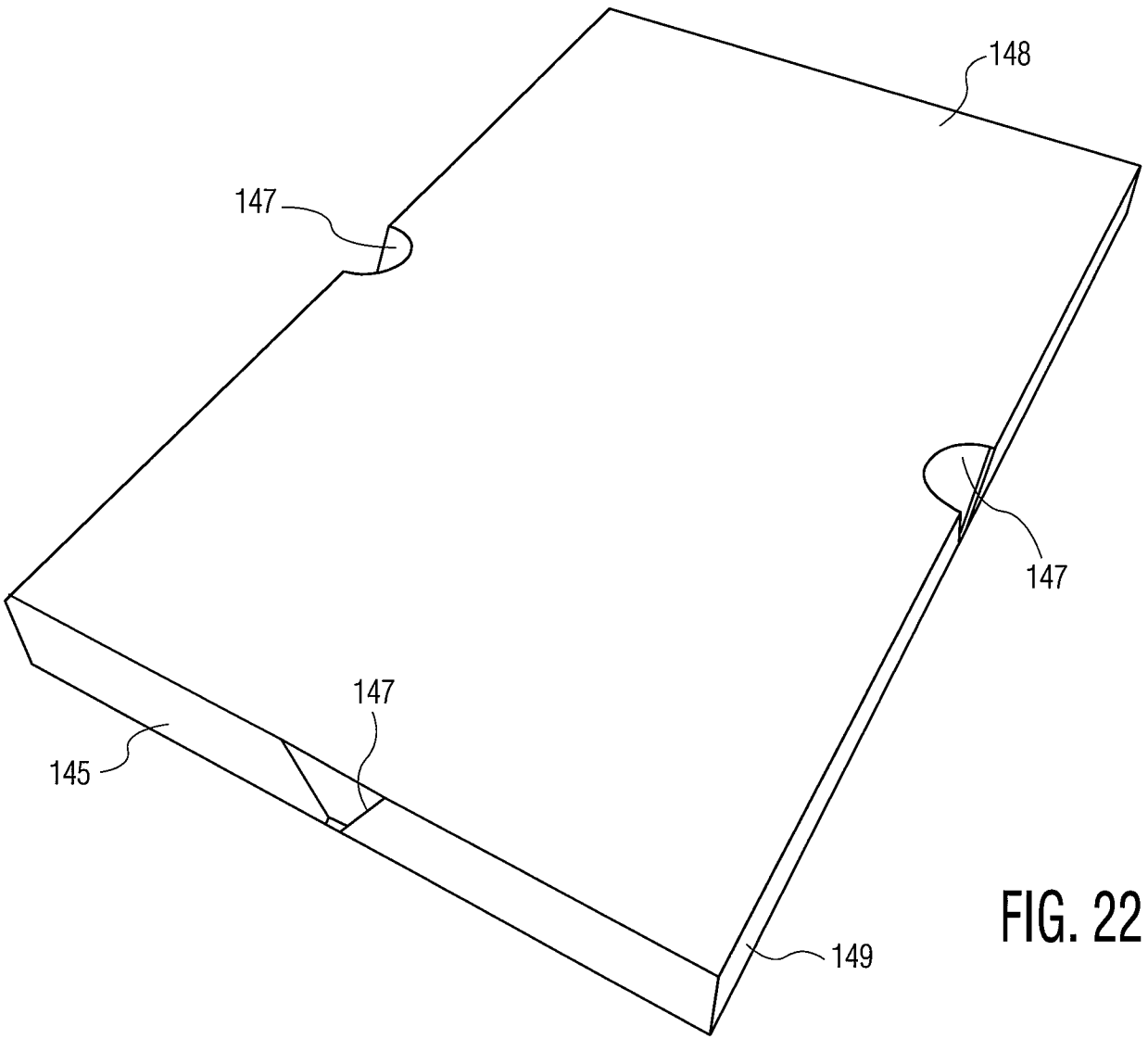
Figure 23:
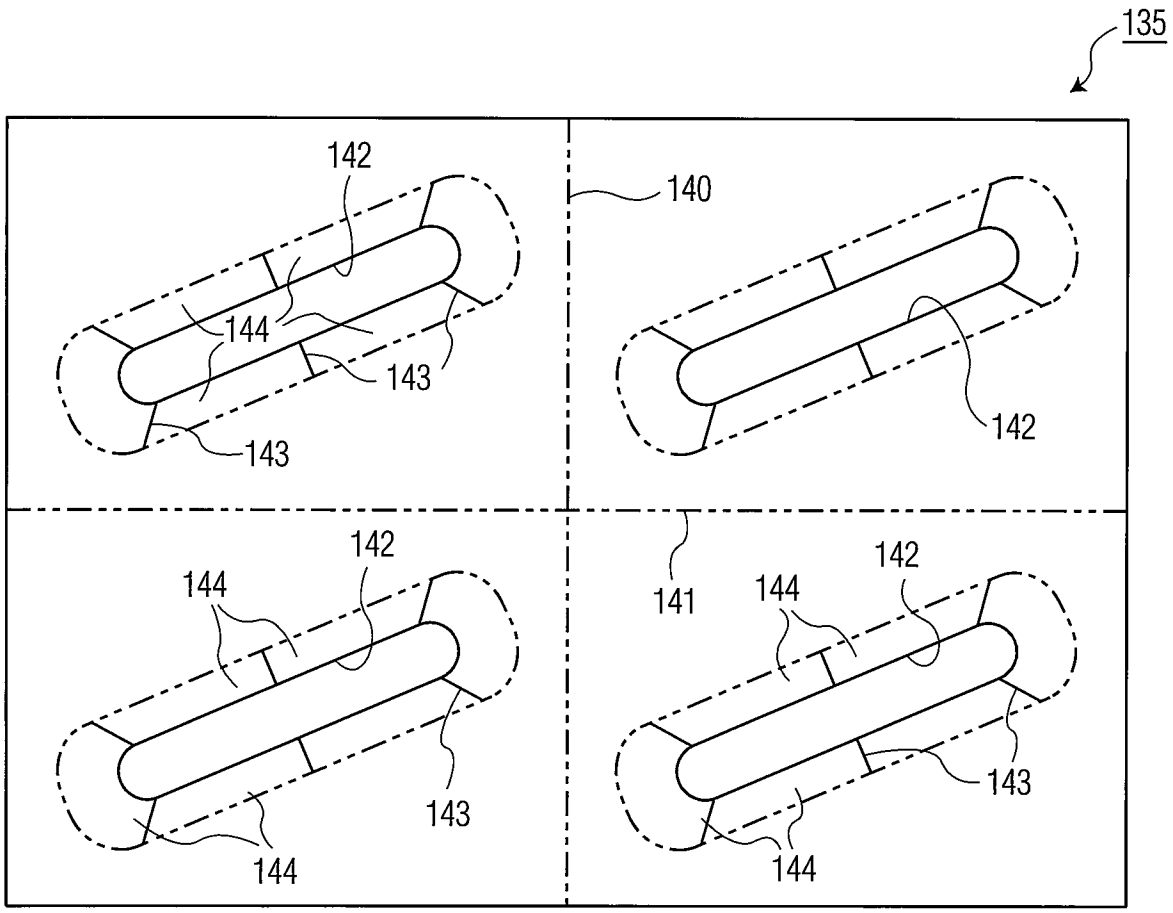
Figure 24:
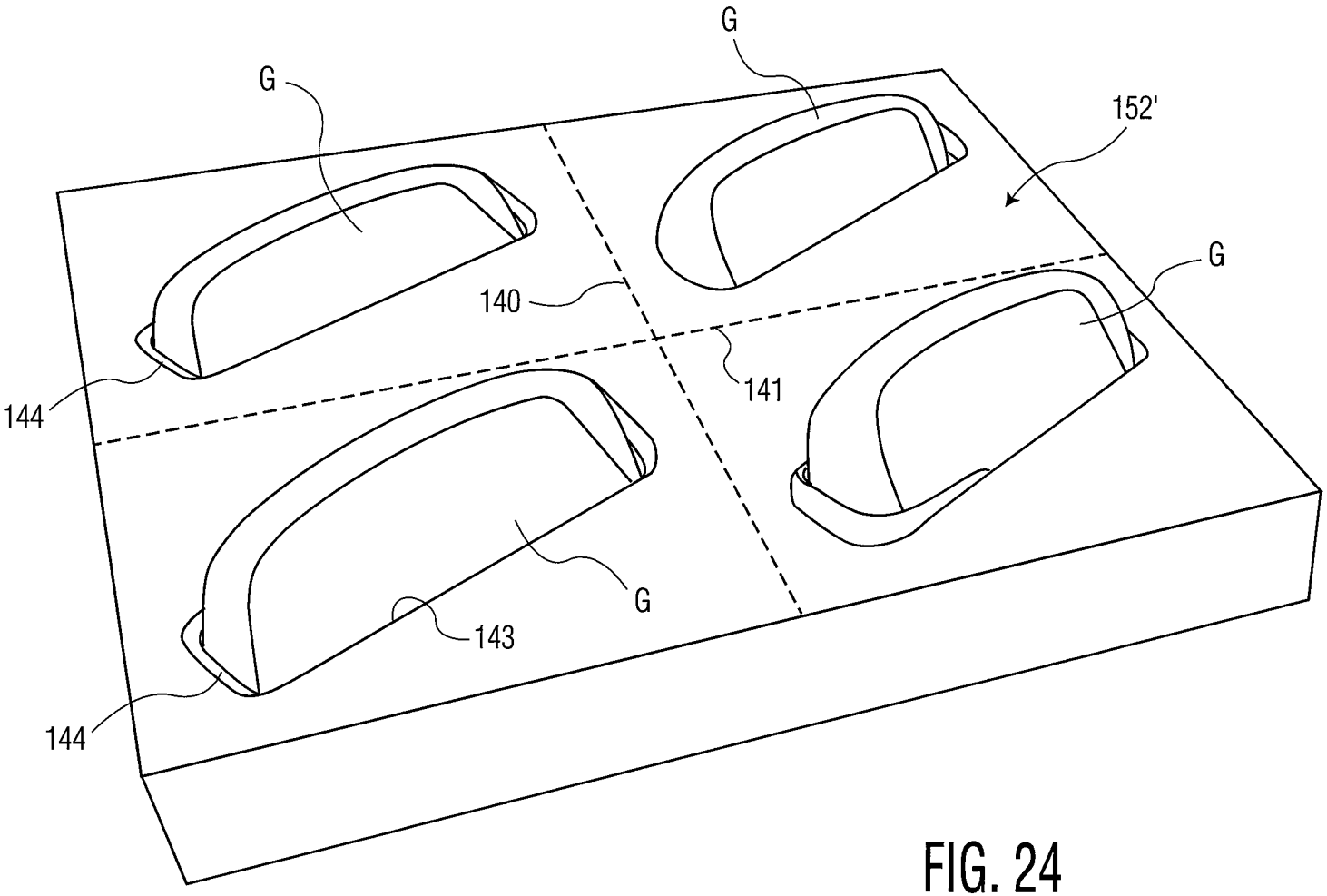

FIG. 21 pictorially illustrates a perspective view of an insert made with the blank of FIG. 20;

FIG. 22 illustrates a perspective bottom view of the insert of FIG. 21;

FIG. 23 illustrates a view of a blank for making a further modified insert;

FIG. 24 illustrates a perspective view of an insert made with the blank of FIG. 23.

Figure 25:
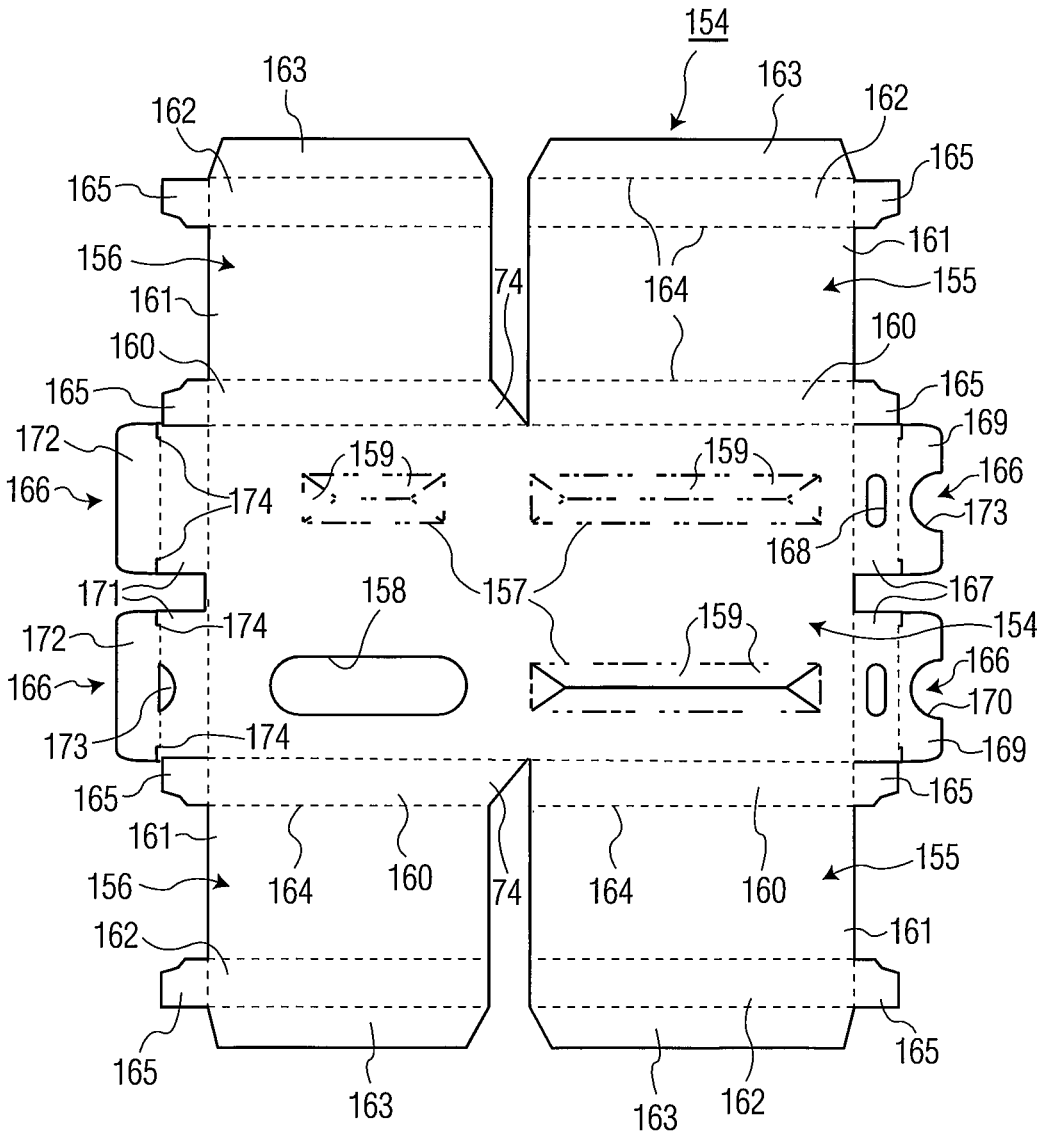
Figure 26:
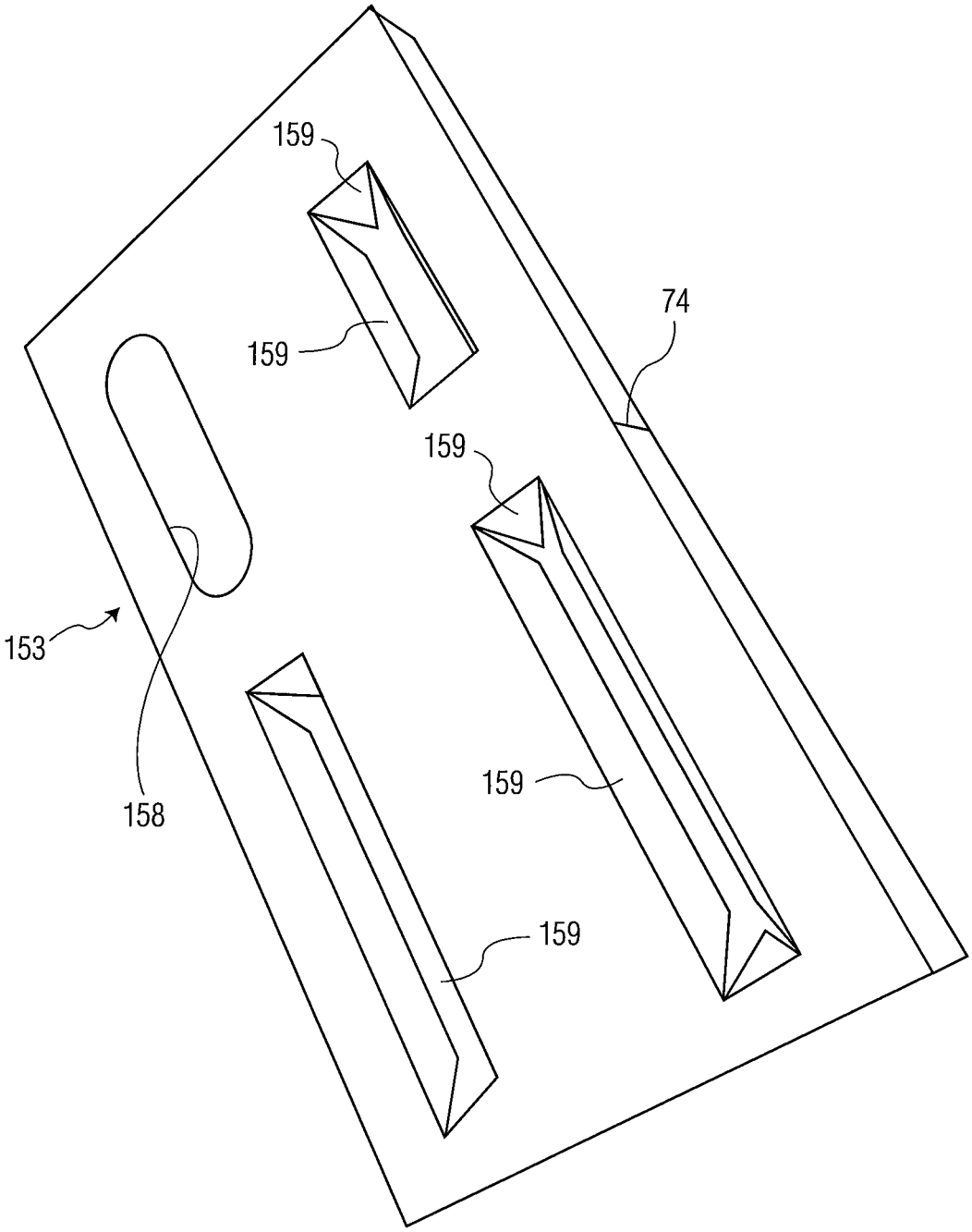
Figure 27:
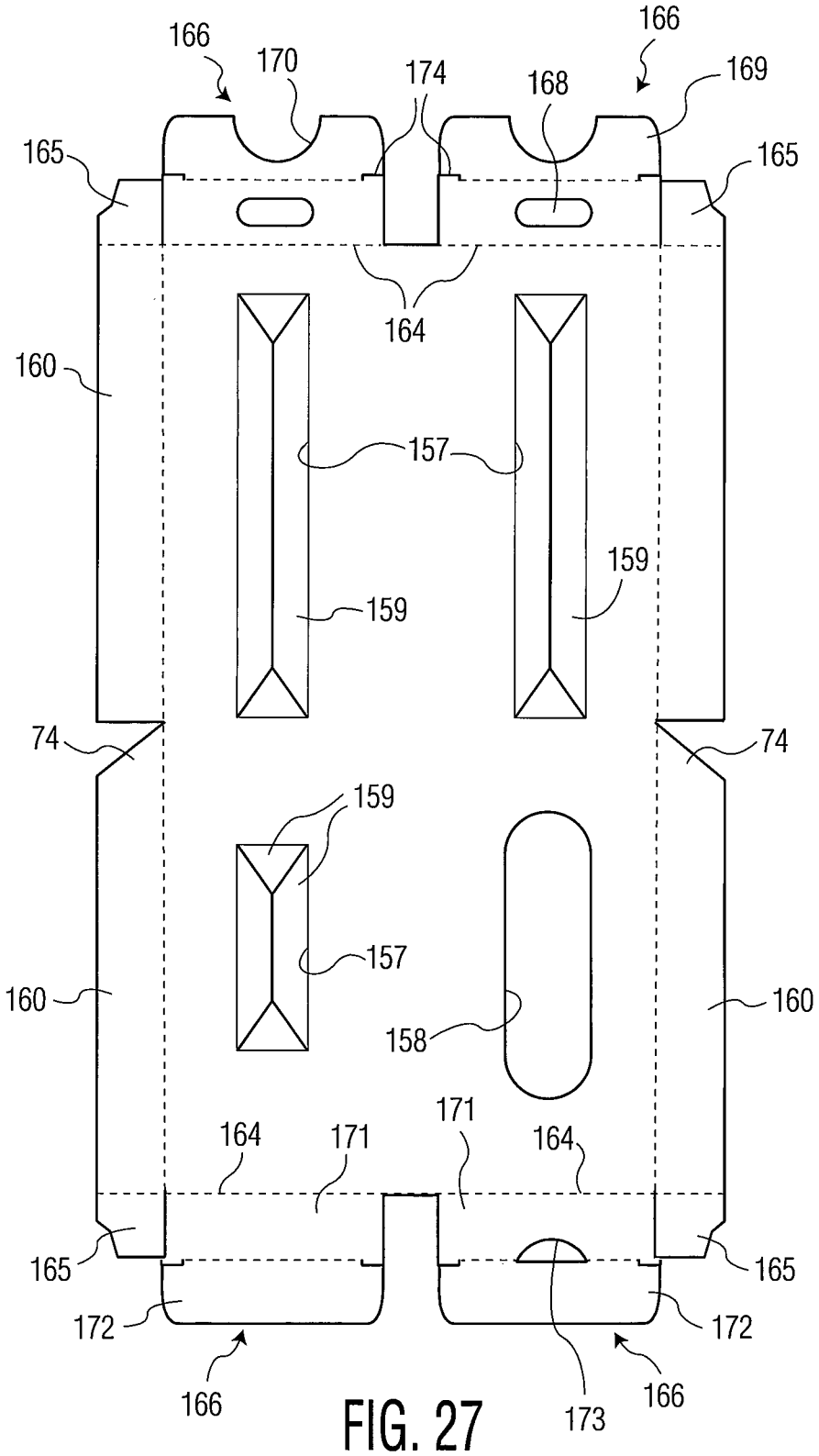
Figure 28:
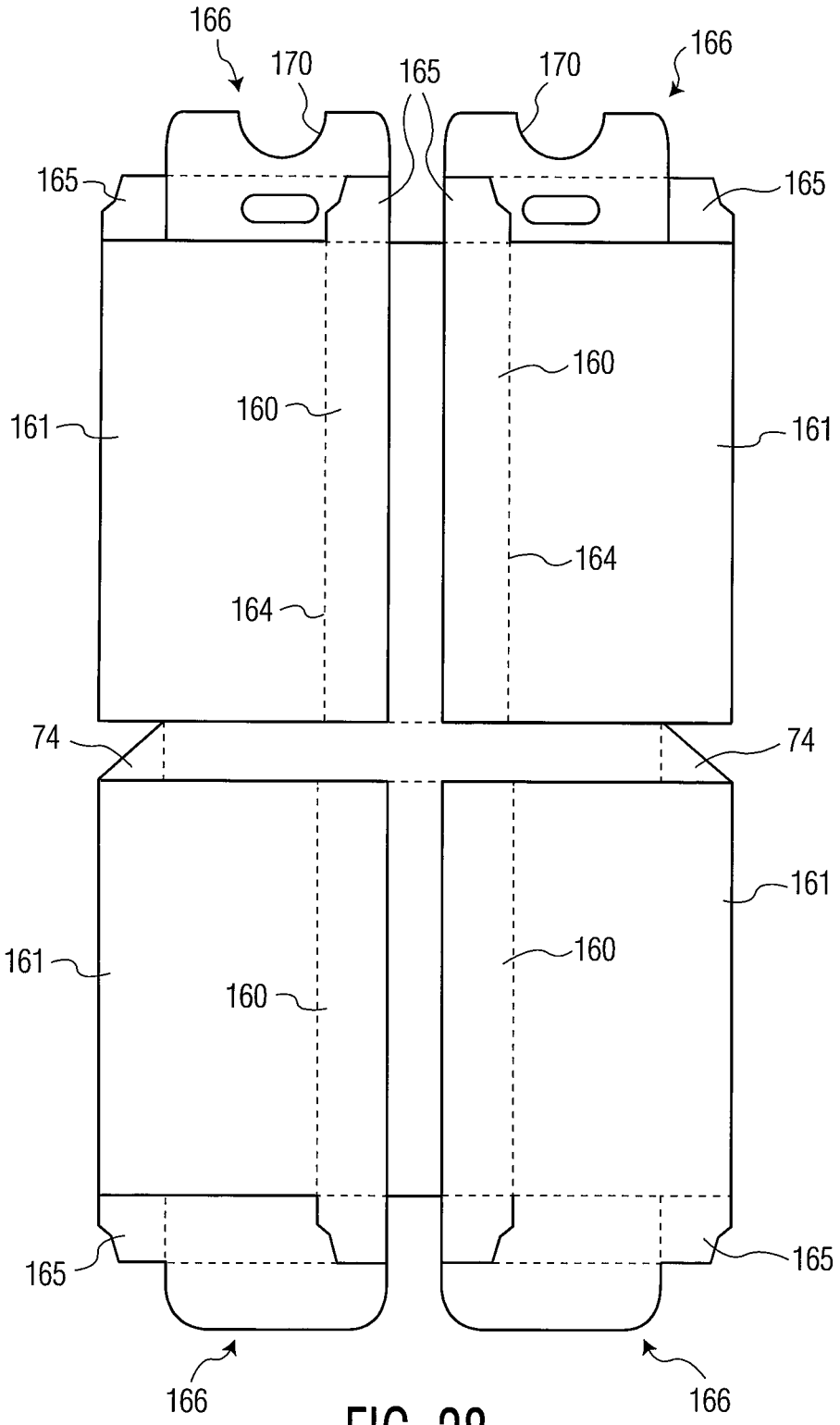
Figure 29:
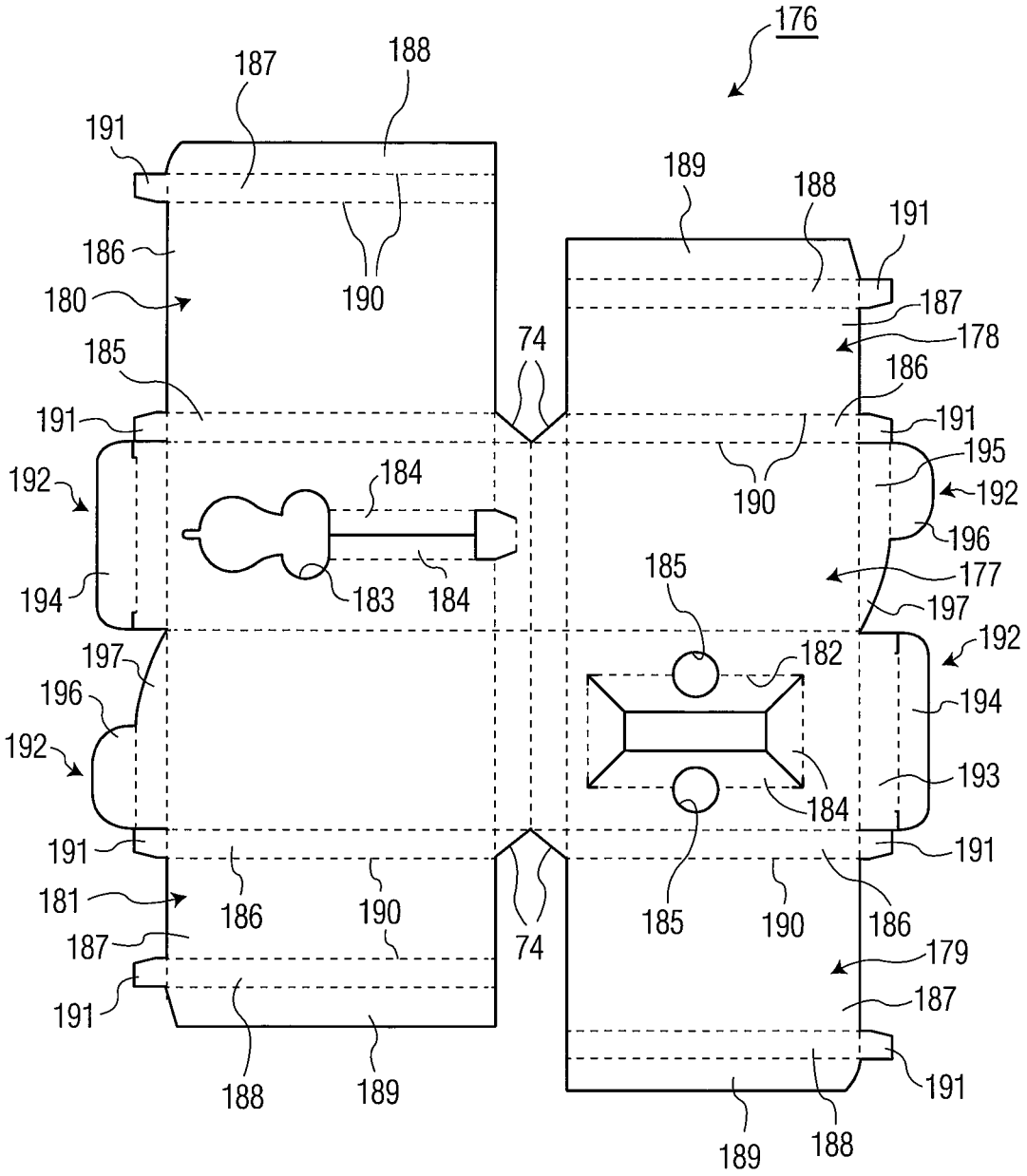
Figure 30:
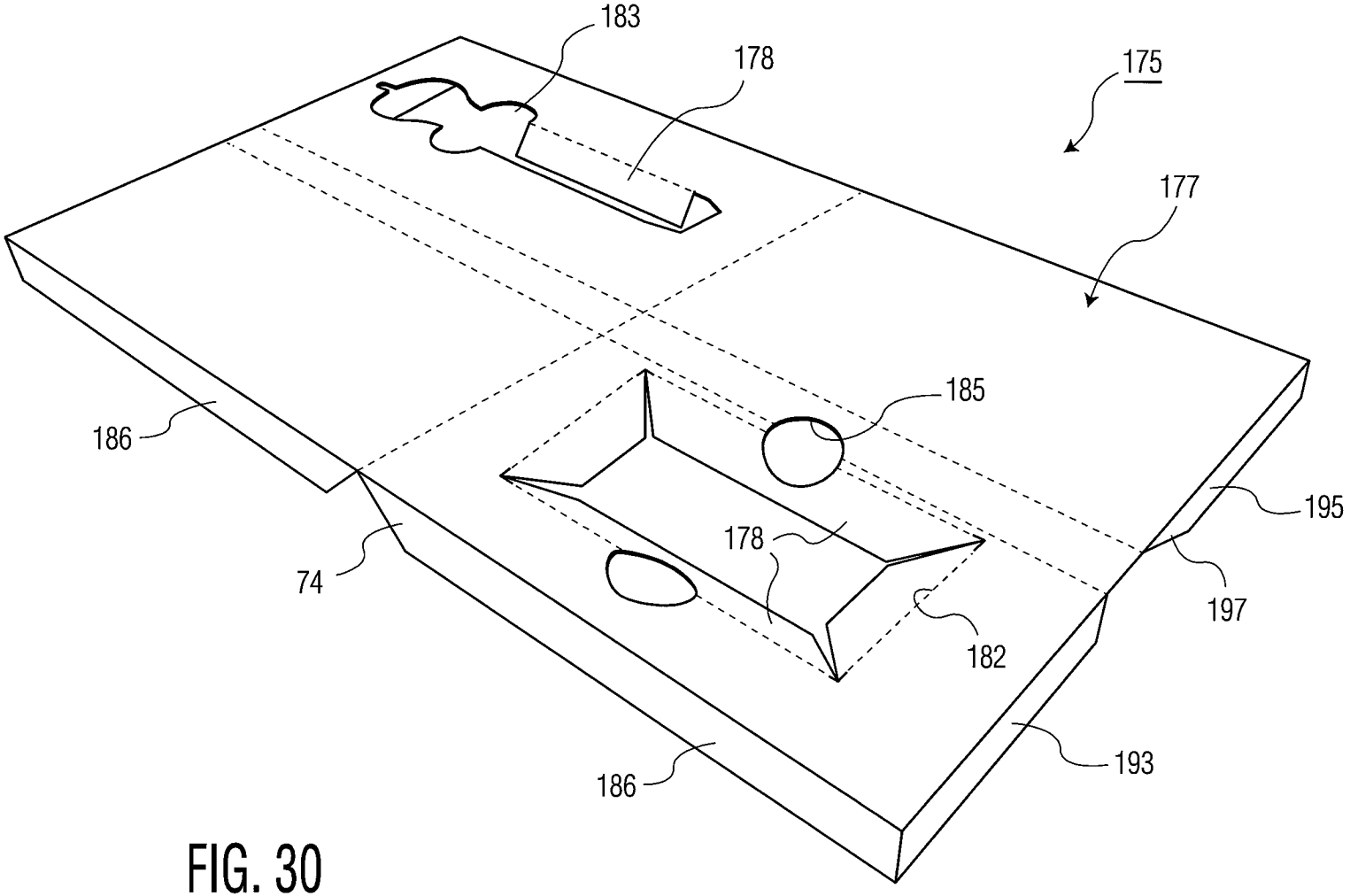
Figure 31:
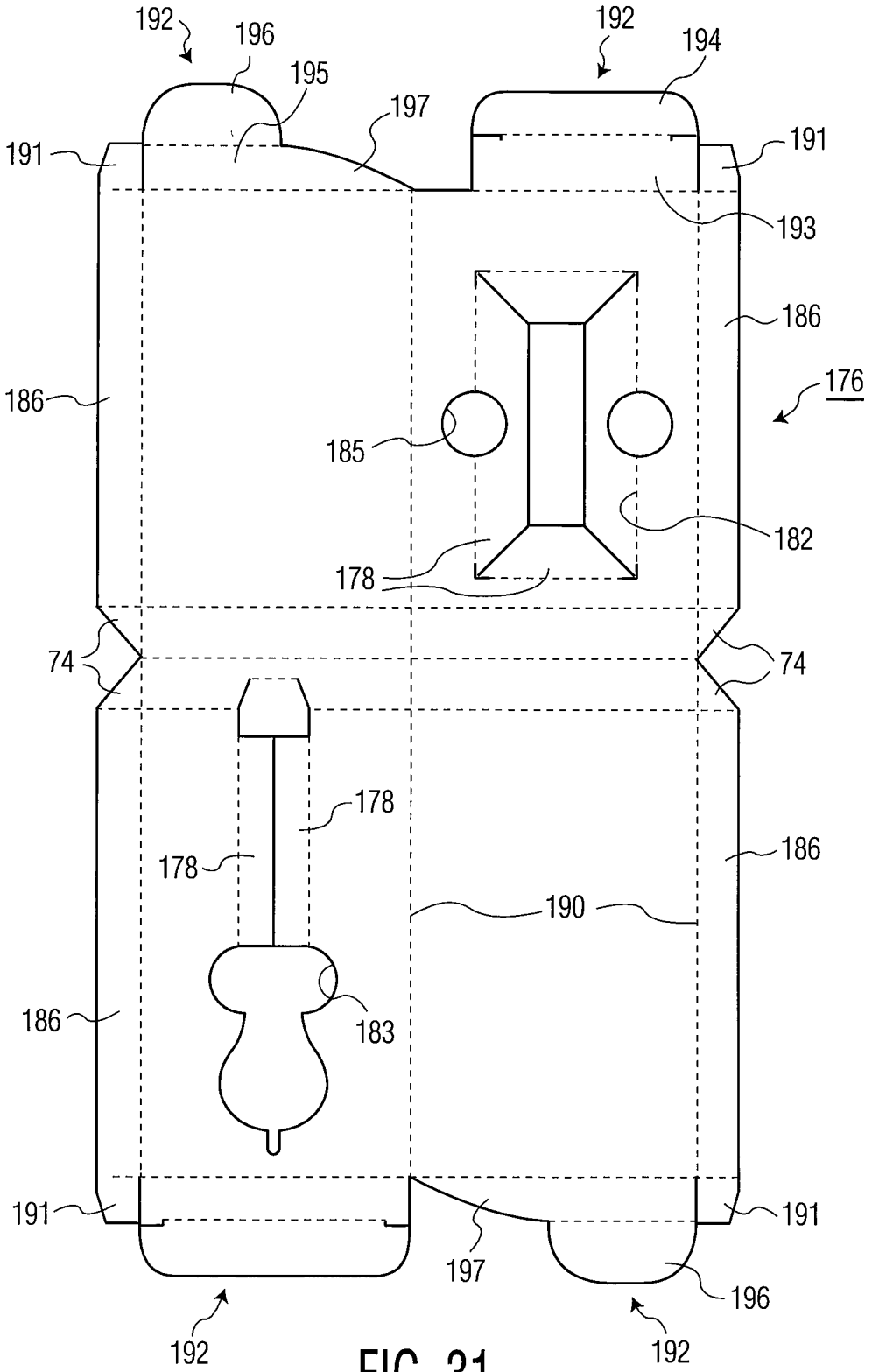
Figure 32:
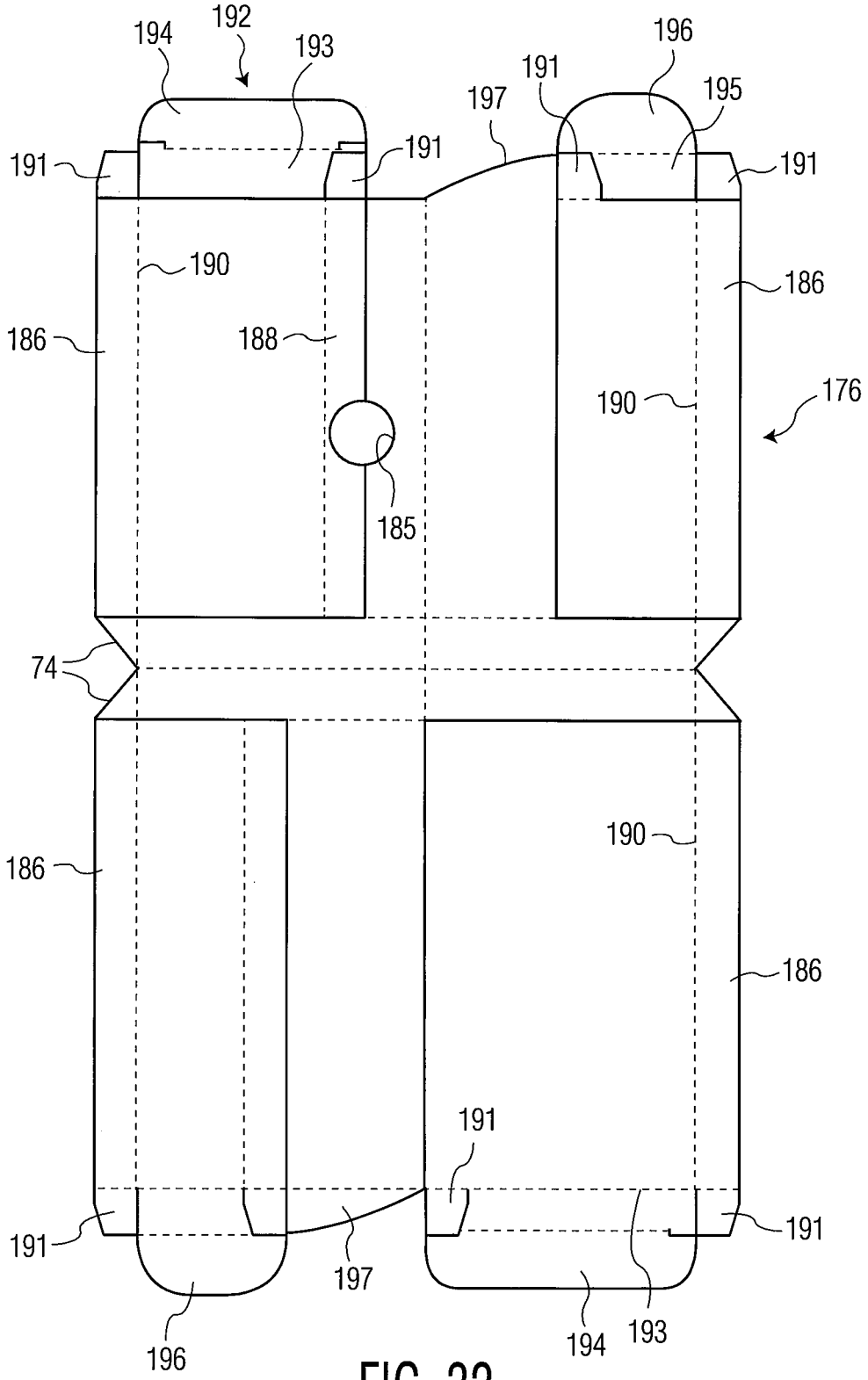
Figure 33:
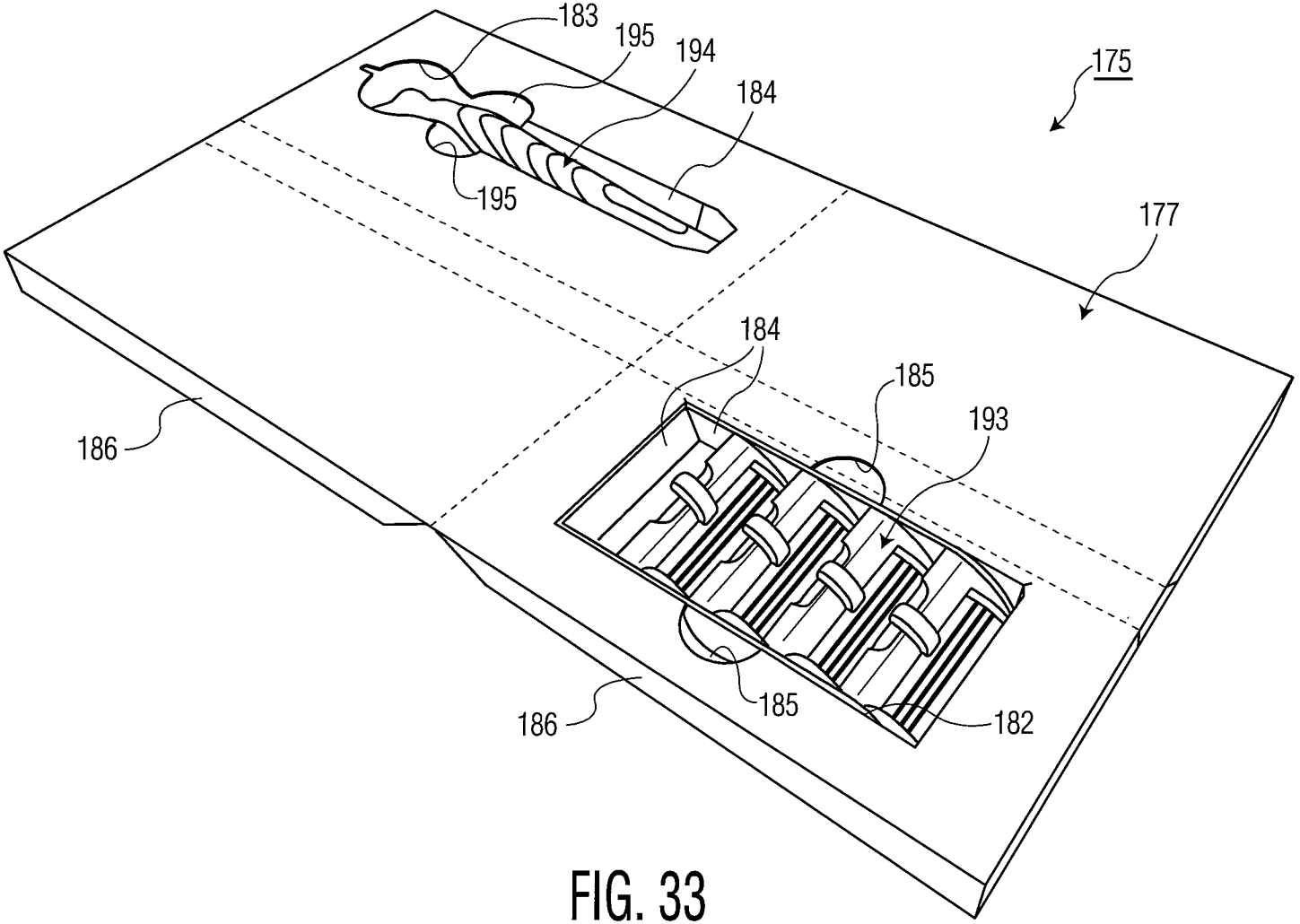
Figure 34:
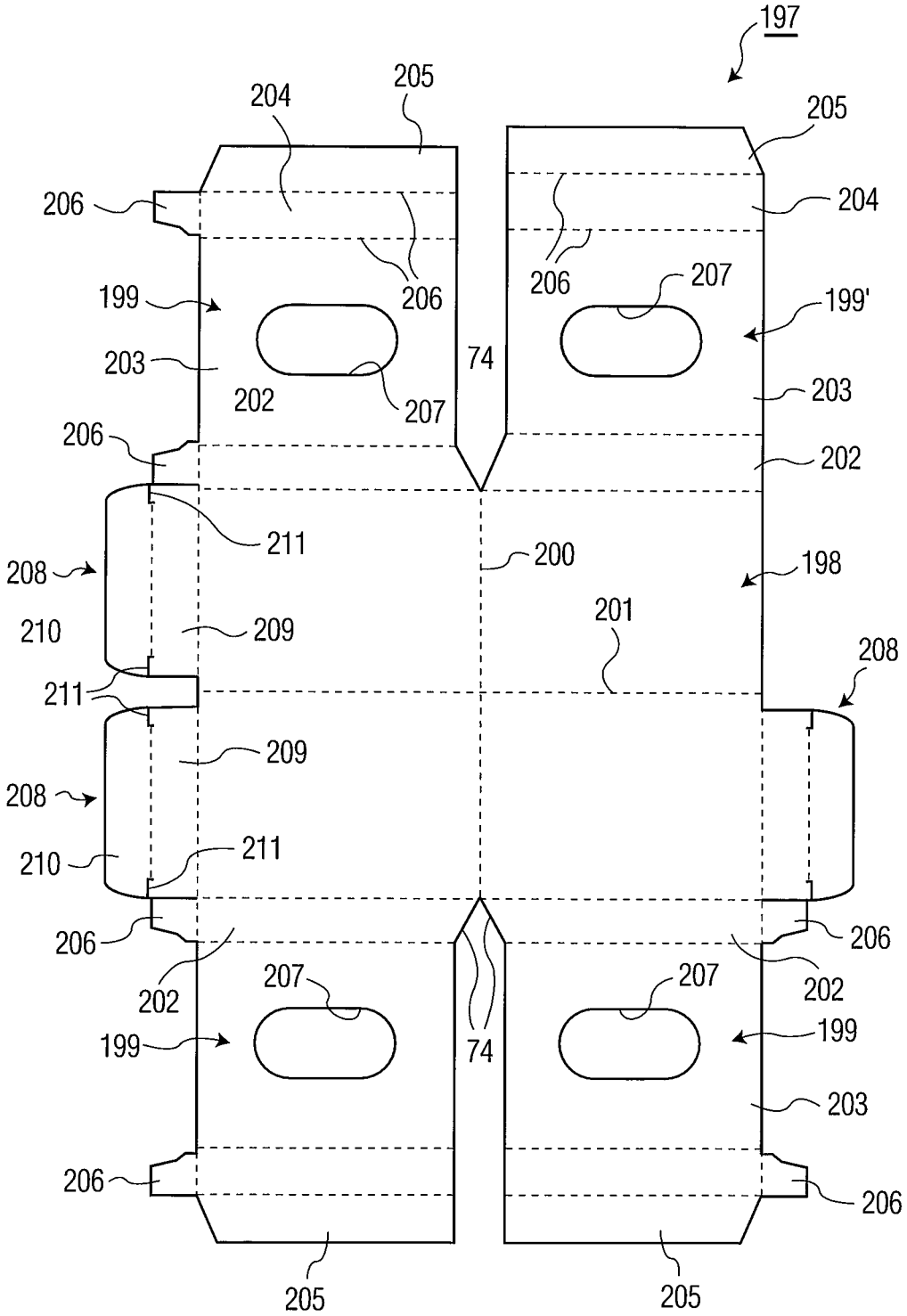
Figure 35:
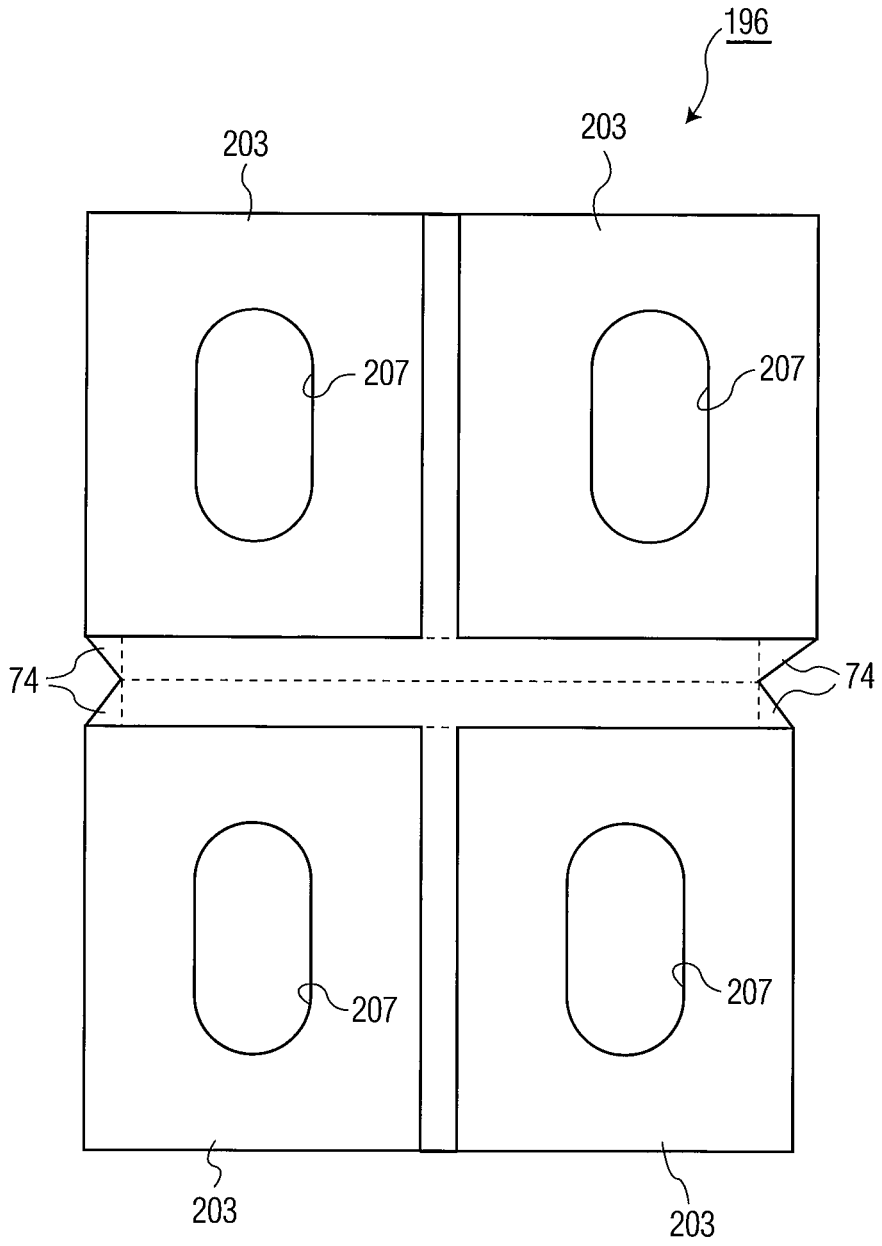
Figure 36:
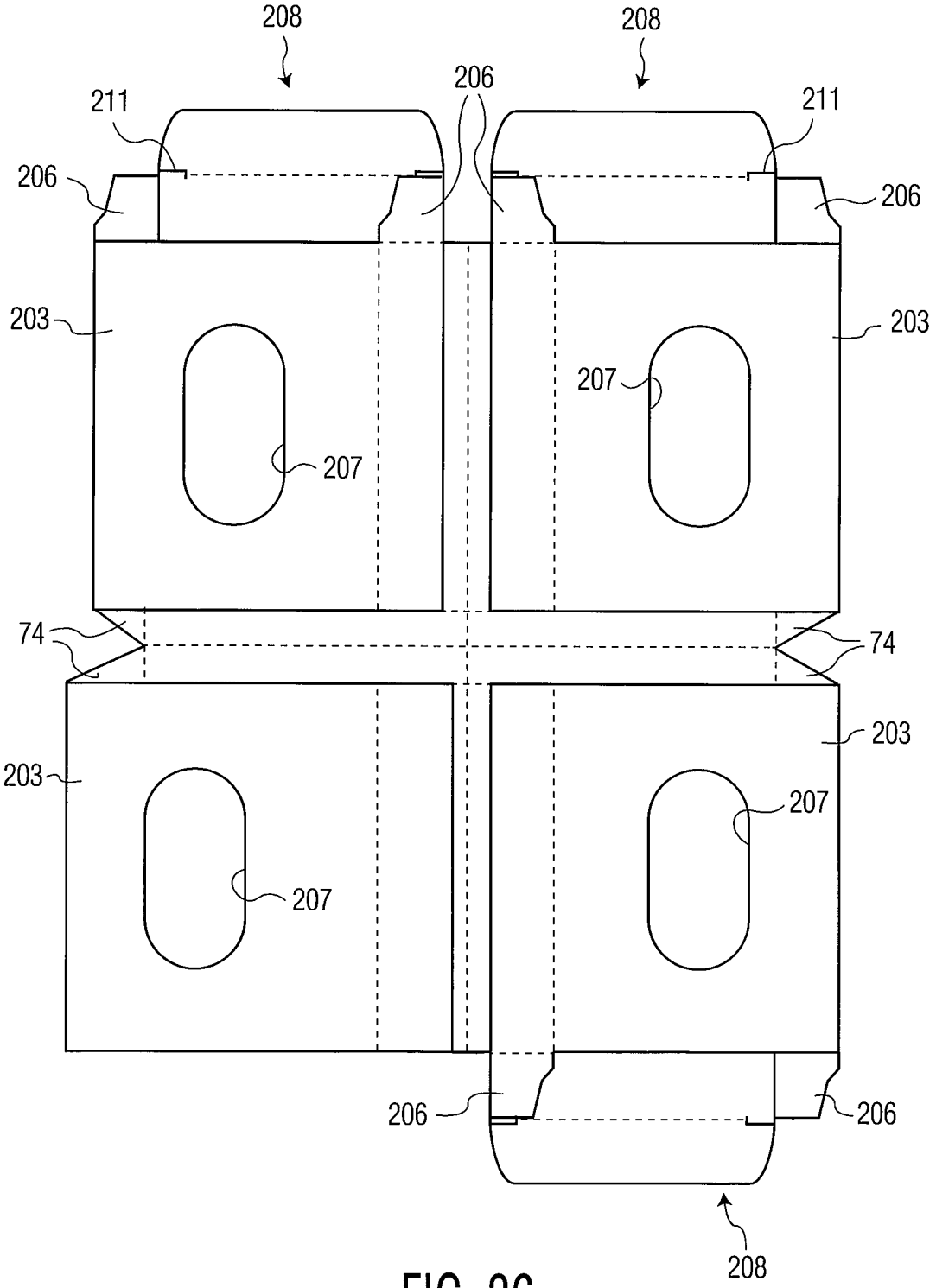
Figure 37:
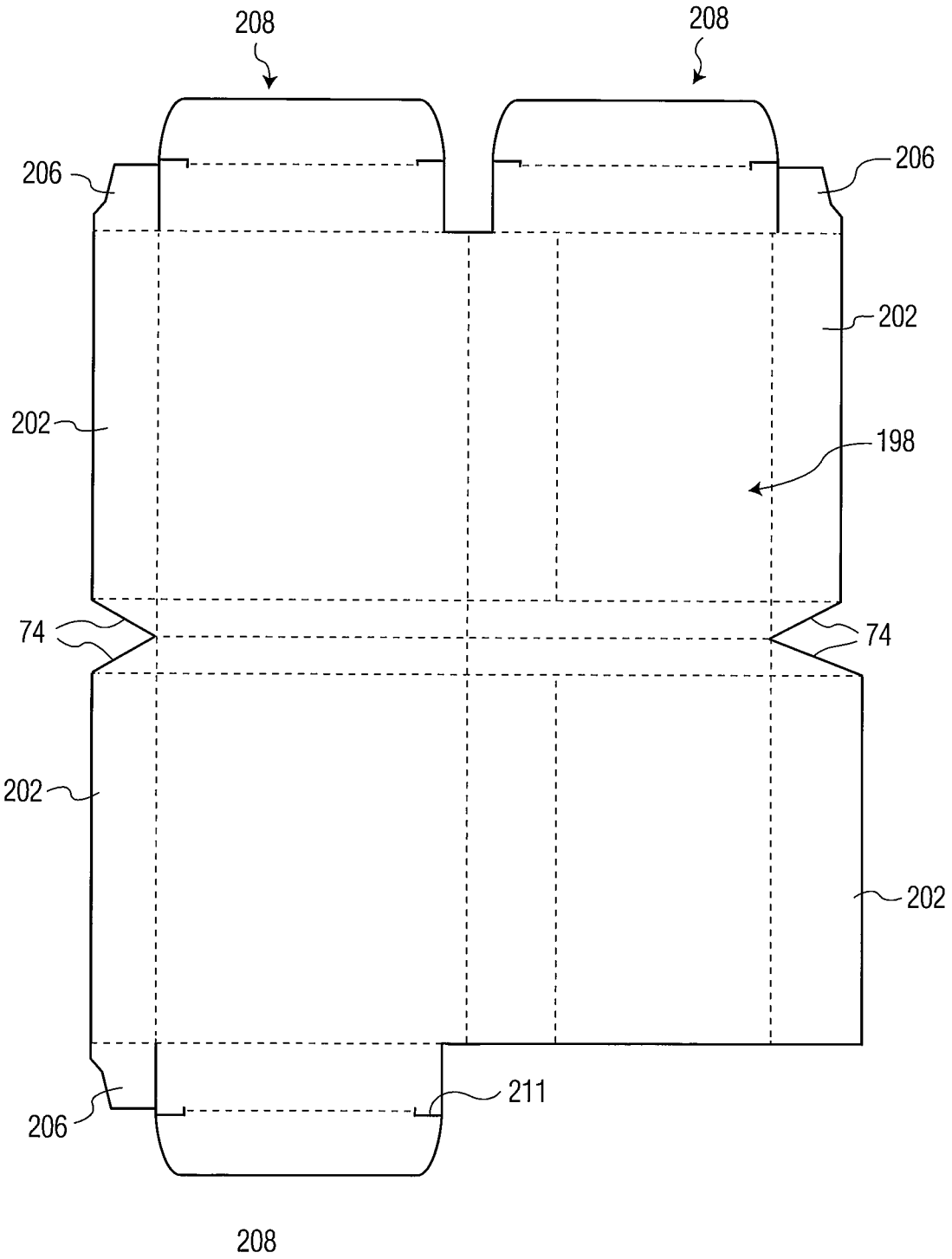

FIG. 25 illustrates a view of a blank for making a further modified insert;

FIG. 26 illustrates a perspective view of an insert made from the blank of FIG. 25;

FIG. 27 illustrates a view of the top side of the flattened insert of FIG. 26 prior to the final folding operations;

FIG. 28 illustrates a view of the bottom side of the flattened insert of FIG. 26 prior to the final folding operations;

FIG. 29 illustrates a view of a blank for making a further modified insert;

FIG. 30 illustrates a perspective view of an insert made from the blank of FIG. 29;

FIG. 31 illustrates a view of the top side of the flattened insert of FIG. 30 prior to the final folding operations;

FIG. 32 illustrates a view of the bottom side of the flattened insert of FIG. 30 prior to the final folding operations;

FIG. 33 illustrates a perspective view of the insert of FIG. 30 with goods in place;

FIG. 34 illustrates a view of a blank for making a further modified insert;

FIG. 35 illustrates a top view of an insert made from the blank of FIG. 34;

FIG. 36 illustrates a view of the top side of the flattened insert of FIG. 35 prior to the final folding operations; and FIG. 37 illustrates a view of the bottom side of the flattened insert of FIG. 35 prior to the final folding operations.

Figure 1:
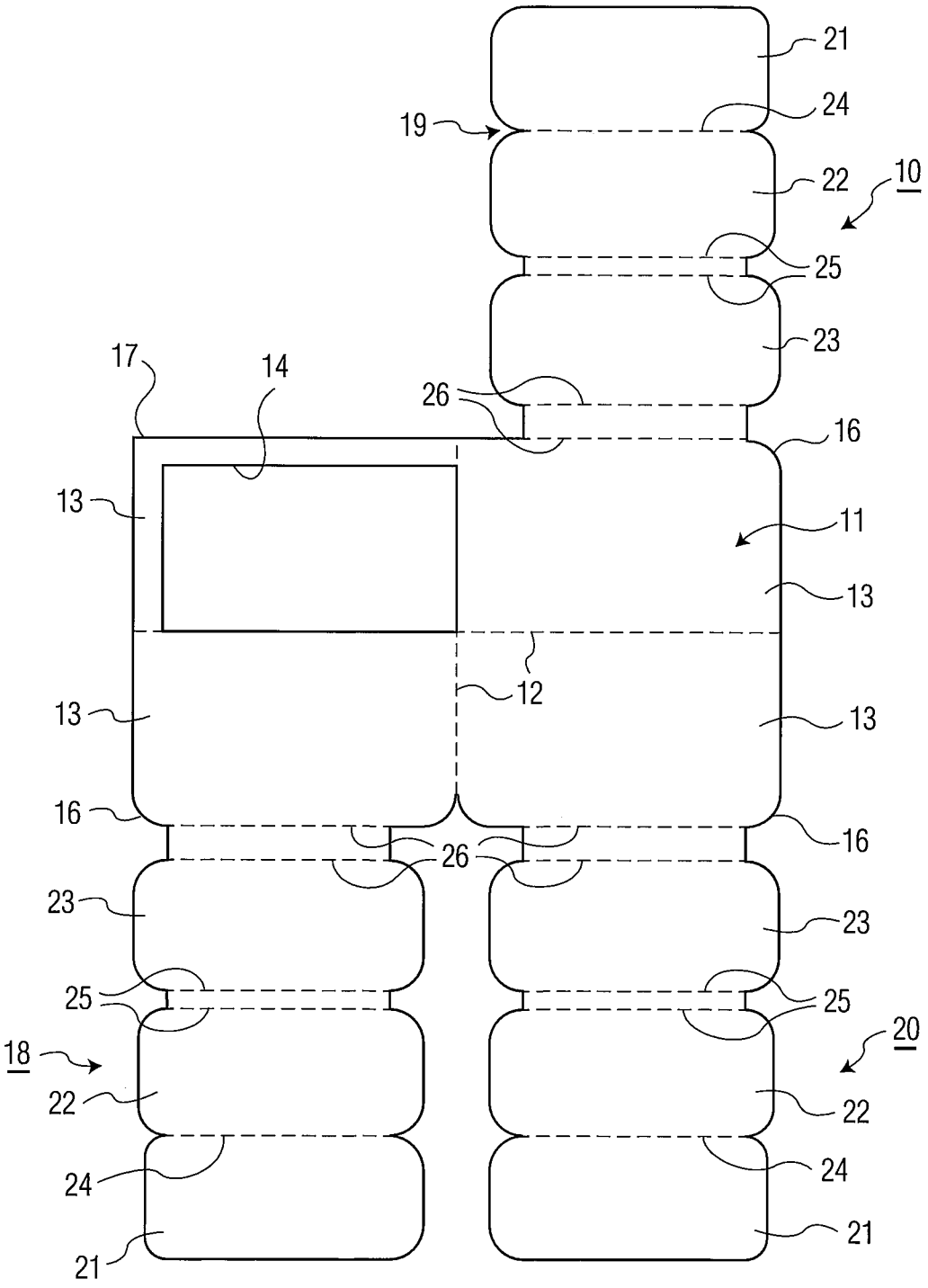
FIG. 1 illustrates a view of a blank in accordance with the invention.

Referring to FIG. 1, the blank 10 for making an insert, i.e. a tray, for an envelope is of one-piece construction of corrugated fiberboard.

Of note, a corrugated fiberboard is a material consisting of a fluted corrugated sheet and one or two flat linerboards. Corrugate made with two flat linerboards, also known as double face corrugate, is typically used for corrugate boxes. Alternatively, corrugate is also constructed of one linerboard, also known as single face corrugate whereby one side of the corrugate is a smooth linerboard, and the other side shows exposed fluting. Either material is suitable for constructing the flexible trays described herein.

The blank 10 includes a main section 11 having a pair of fold or score lines 12 at right angles to each other to separate the main section 11 into four quadrant components 13. In addition, one of the quadrant components 13 includes a rectangular opening 14 for receiving an item (not shown) to be packaged and shipped.

The opening may be die cut as a window to hold contents from shifting.

As illustrated, the four quadrant components 13 may have rounded corners 16 or right-angled corners 17.

The blank 10 also includes three extensions 18, 19, 20.

A first extension 18 extends from one quadrant component 13 and has three sections 21, 22, 23, a first fold line 24 between and separating the outermost section 21 from the middle section 22, a first pair of parallel spaced apart fold lines 25 between and separating the middle section 22 from the innermost section 23 and a second pair of parallel spaced apart fold lines 26 between and separating the innermost section 23 from the rectangular component 12.

Figure 2:
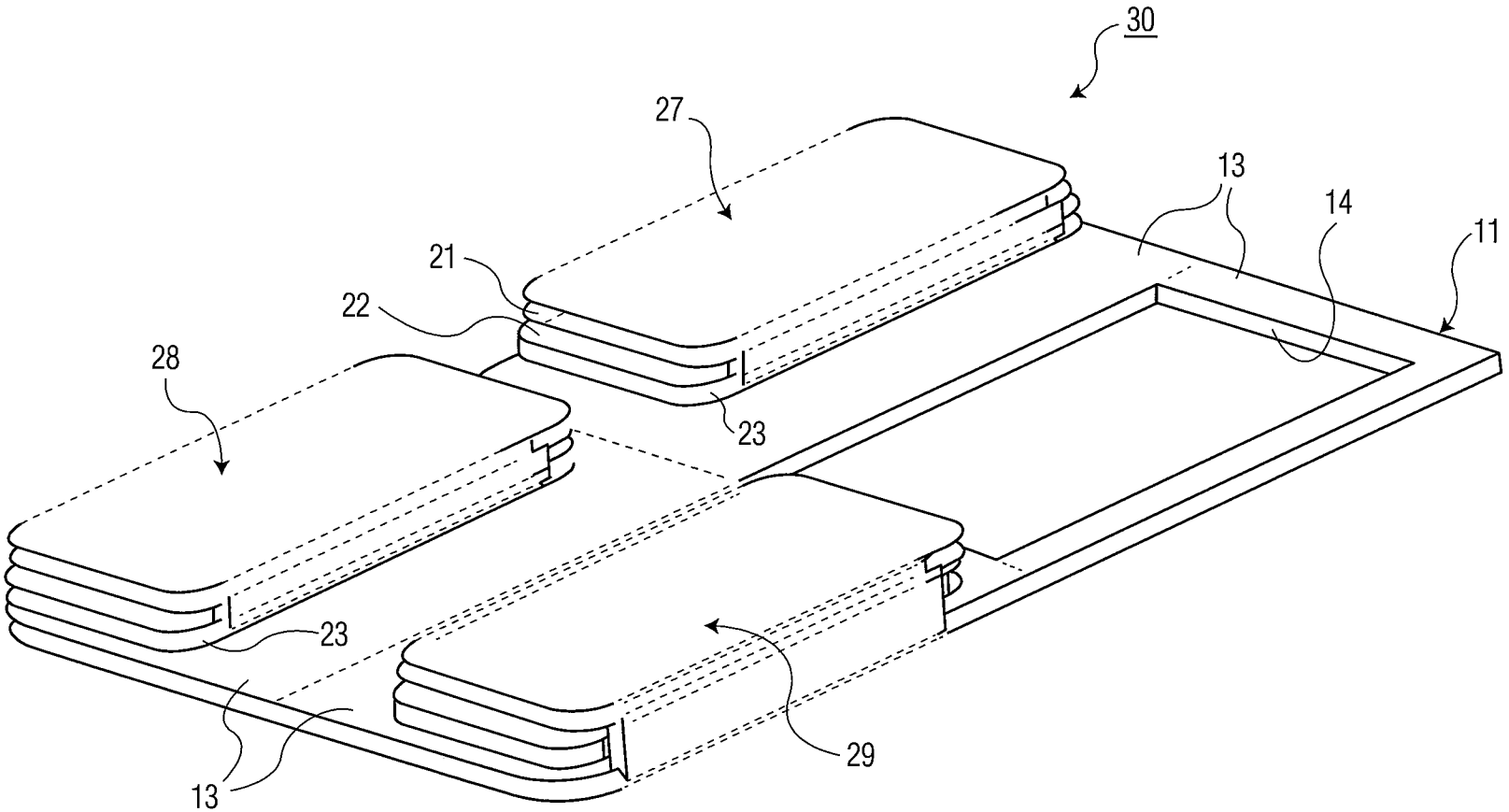
FIG. 2 illustrates a perspective view of an insert assembled from the blank of FIG. 1.

As illustrated in FIG. 2, the three sections 21, 22, 23 of the extension 18 are sized to fold over each other to form a multi-layer spacer 27 in contact with and along one edge of the main section 11. As indicated, the spacer 27 has a thickness equal to the sum of the thicknesses of the three sections 21, 22, 23.

The first pair of parallel spaced apart fold lines 23 are spaced apart a distance to accommodate the thickness of the outermost and middle sections 21, 22 and the second pair of parallel spaced apart fold lines 26 accommodate the thickness of the three sections 21, 22, 23.

For example, where each section 21, 22, 23 has a thickness of 0.125 inches, the spacer 27 has a thickness of 0.375 inches, the first pair of parallel spaced apart fold lines 23 are spaced apart 0.250 inches and the second pair of parallel spaced apart fold lines 26 are spaced apart 0.500 inches.

The second extension 19 extends from one side of another quadrant component 13 and the third extension 20 extends from the opposite quadrant component 13. The two extensions 19, 20 are of similar construction to the first extension 18 and like reference characters indicate like parts as above. The three sections 21, 22, 23 of the two extensions 19, 20 are sized to fold over each other to form a multi-layer spacer 28, 29 in contact with and along a respective edge of the main section 11.

As illustrated the sections 21, 22, 23 of each extension 18, 19, 20 are of rectangular shape with rounded corners as illustrated or with right-angled corners (not shown).

Referring to FIG. 2, in order to form an insert (tray) 30, each section 21, 22, 23 of each extension 18, 19, 20 of the blank 10 is folded on itself to form a respective three-ply spacer 27, 28, 29 disposed against the main section 11.

A suitable glue (not shown) is disposed on the underside, as viewed, of the middle section 22 of each extension 18, 19, 20 to secure the folded over extension to the main section 11.

The thickness of the insert 30 at the location of each spacer 27, 28, 29 is thus equal to the combined thicknesses of the three sections 21, 22, 23 and the main section 11, i.e. 0.500 inches.

Depending on the thickness of the goods inserted, the flexible tray 30 thickness must be a minimum of ¼" up to a max of ¾" thick to comply with USPS rules of a minimum thickness of ¼" and max of ¾", keeping in mind that there cannot be a bump greater than ¼. The thickness of the flexible insert (tray) 30 is created to ensure compliance with these rules.

Figure 3:
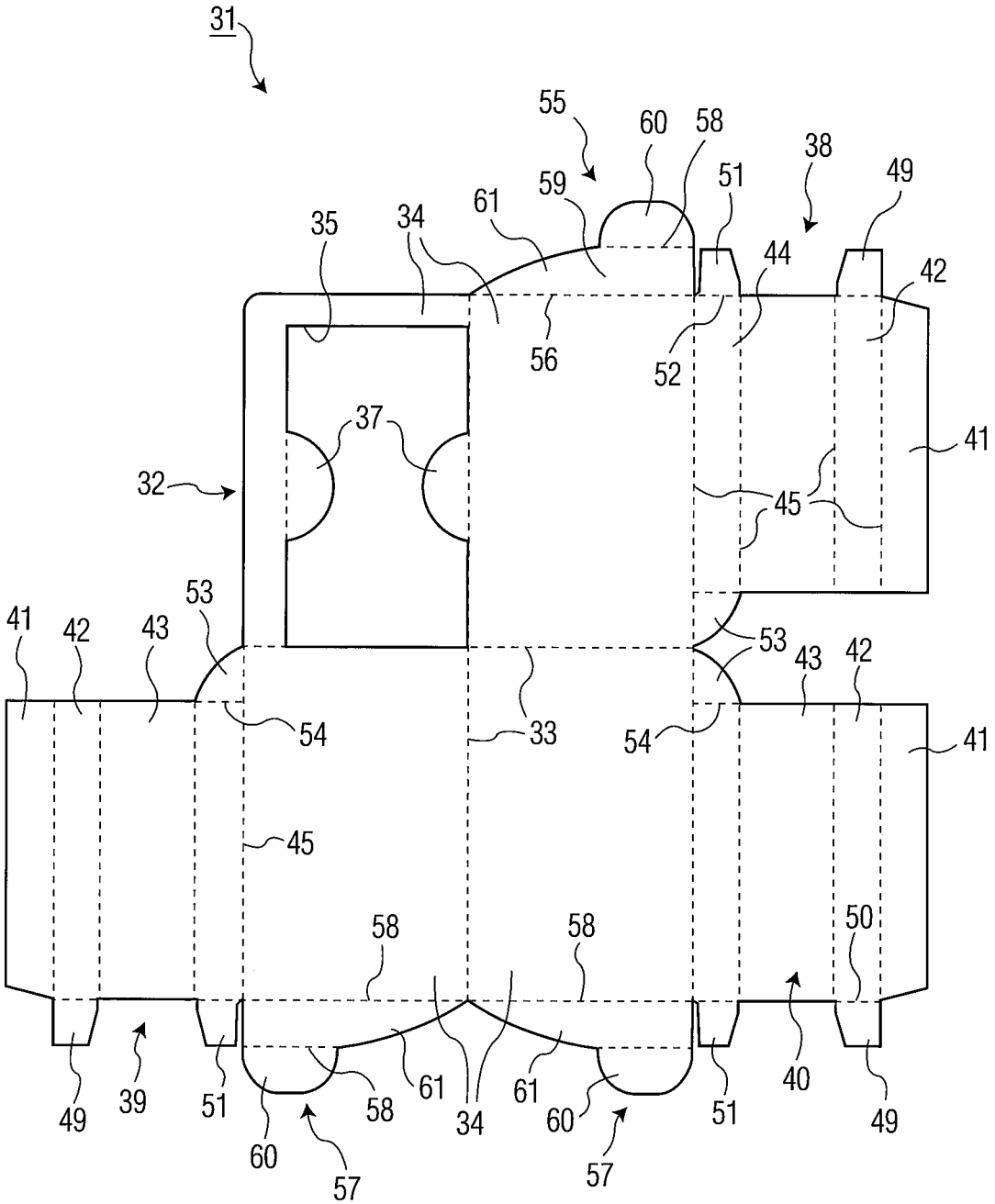
FIG. 3 illustrates a view of a further blank in accordance with the invention

By way of example, the dimensions of the blank 10 are as follows:

- rectangular components 12, 13—length 5.750 inches
- outermost section 21—length 1.812 inches, width 4.250 inches
- middle section 22—length 1.875 inches, width 4.250 inches
- innermost section 23—length 1.937 inches, width 4.250 inches Referring to FIG. 3, in another embodiment, the blank 31 for making an insert for an envelope is of one-piece construction of paperboard, for example, of a thickness of 0.625 inches with a paper weight in the range of 8 pt. to 20 pt with a preferred range of 10 pt to 16 pt.

The blank 31 includes a main section 32 having a pair of fold or score lines 33 at right angles to each other to separate the main section 32 into four quadrant components 34. In addition, one of the quadrant components 34 includes a rectangular opening 35 for receiving an item (not shown) to be packaged and shipped as well as two tabs 37 that project into the opening 35 for folding out to hold the item in place. For example, for shipping an item of rectangular shape, the opening 35 is of rectangular shape and the tabs 37 are of hemi-spherical shape.

The blank 31 also includes three extensions 38, 39, 40.

The first extension 38 extends from one quadrant component 34 and has four sections 41, 42, 43, 44 separated by fold lines 45 or other lines of weakening, such as a line of perforations, from each other and the main section 11. As illustrated in FIG. 3, the four sections 41, 42, 43, 44 of the extension 38 are sized to be assembled into an integrated folding carton 46 (see FIG. 6) along one edge of the main section 32 to function as a spacer for the resultant insert.

Figure 6:
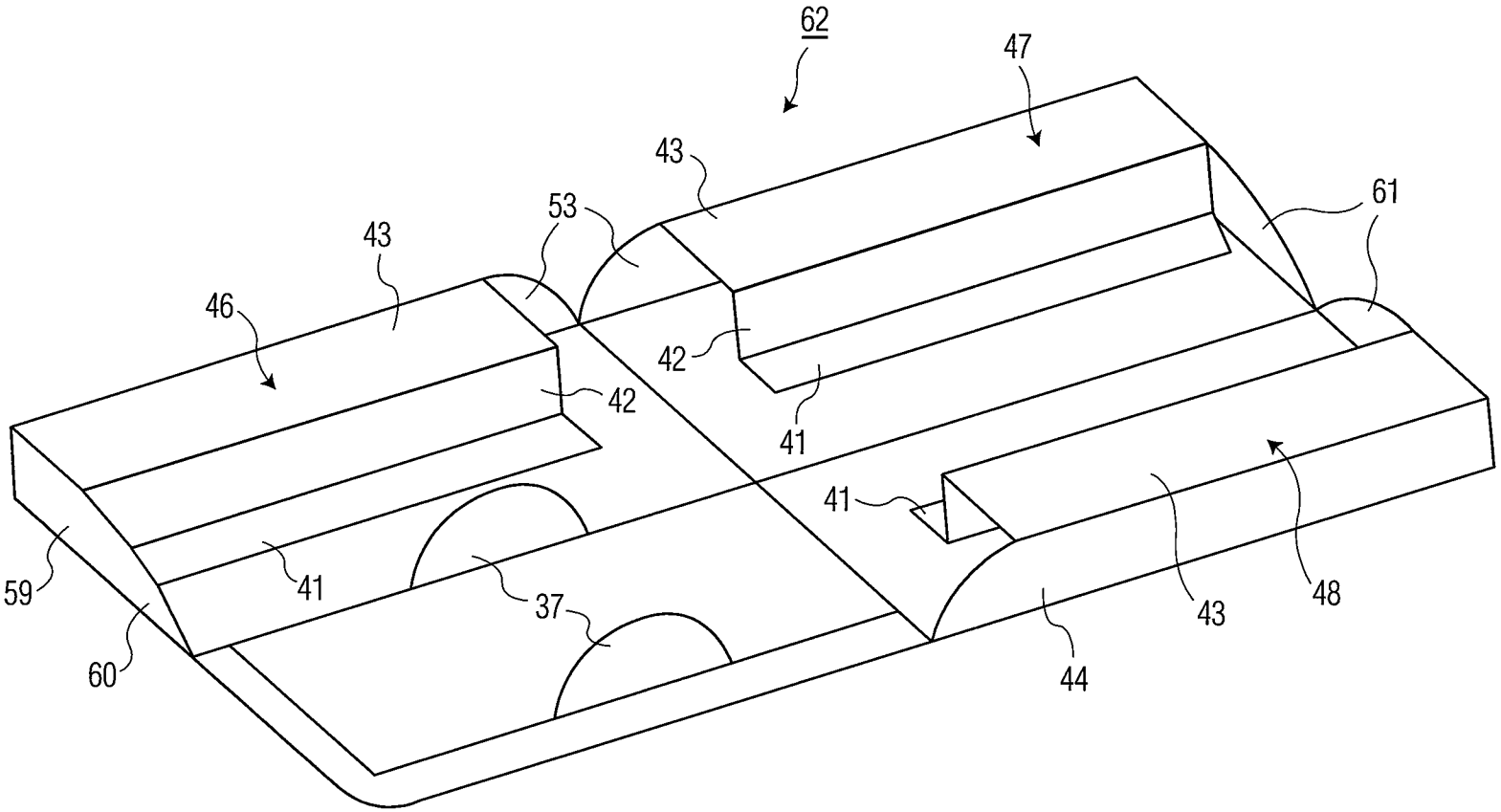
FIG. 6 illustrates a perspective view of an insert assembled from the blank of FIG. 3.

As indicated in FIG. 6, the integrated folding carton 46 is in the form of a hollow block of elongated shape with a rectangular cross-section.

The second extension 39 extends from one side of another quadrant component 34 and the third extension 40 extends from an opposite quadrant component 34.

The two extensions 39, 40 are of similar construction to the first extension 38 and like reference characters indicate like parts as above.

The four sections 41-44 of the two extensions 39, 40 are sized to be assembled into integrated folding cartons 47, 48 in contact with and along a respective edge of the main section 32.

The outermost section 41 of each extension 38, 39, 40 is of generally rectangular shape.

The next section 42 of each extension 38, 39, 40 is of generally rectangular shape with a tab 49 extending laterally thereof and a fold line 50 separating the tab 49 from the section 42.

The next section 43 of each extension 38, 39, 40 is of rectangular shape The innermost section 44 of each extension 38, 39, 40 is of generally rectangular shape with a tab 51 extending laterally thereof, a fold line 52 separating the tab 51 from the innermost section 44, a rounded gusset 53 extending laterally thereof opposite the tab 51 and a fold line 54 separating the rounded gusset 53 from the innermost section 42.

Referring to FIG. 3, as illustrated, a flap 55 extends from the quadrant component 34 having the opening 35 and a line of weakening 56 separates the flap 55 from the component 34. In addition, a pair of spaced apart flaps 57 extend from two other quadrant components 34 on the opposite side of the main section 32 being separated therefrom by lines of weakening 58.

As indicated, the flaps 55, 57 are of similar shape with a rectangular component 59, a hemispherical component 60 separated by a line of weakening 58 from the rectangular component 60 and a triangular component 61 with a rounded hypotenuse.

Referring to 3 to 6, in order to form an insert 62 (see FIG. 6), each extension 38, 39, 40 of the blank 31 is assembled to form a respective integrated folding carton 46, 47, 48 disposed against the main section 32. To this end, the innermost section 44 of each extension 37, 38, 39 is folded upwardly 90° relative to the respective quadrant component 34. The tab 51 is then folded inwardly 90° relative to the section 44. The tab 51 may also be folded inwardly at a later stage of assembly.

The next section 43 of each extension 38, 39, 40 is then folded 90° relative to the innermost section 44 to be disposed in parallel to the respective quadrant component 34.

The next section 42 of each extension 38, 39, 40 is then folded downwardly 90° relative to the section 43 to be disposed in perpendicular relation to the main section 32. The tab 49 is then folded inwardly 90° relative to the section 44. The tab 49 may also be folded inwardly at a later stage of assembly.

Figure 4:
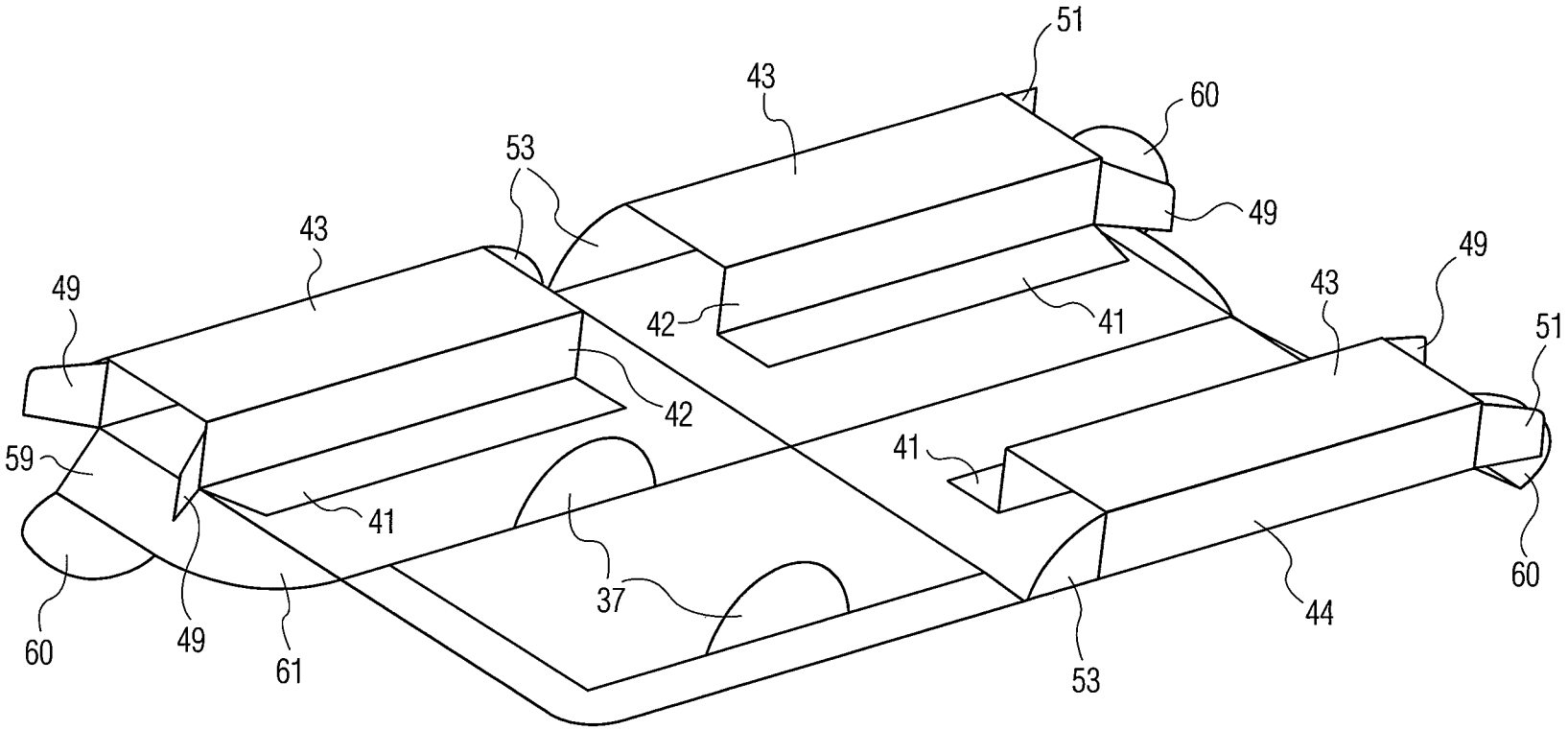
FIG. 4 illustrates a perspective view of the blank of FIG. 3 during an initial stage of assembly into an insert.

The next and outermost section 41 of each extension 38, 39, 40 is then folded outwardly 90° relative to the section 42 to be disposed flat against the main section 32 to form the respective integrated carton 46, 47, 48 disposed against the main section 32. (see FIG. 4)

A suitable glue is disposed on the outermost section 41 of each extension 38, 39, 40 to secure the section 41 to the main section 32.

If not previously folded in, the tabs 49, 51 of each extension 38, 39, 40 are folded inwardly. (See FIG. 5)

Figure 5:
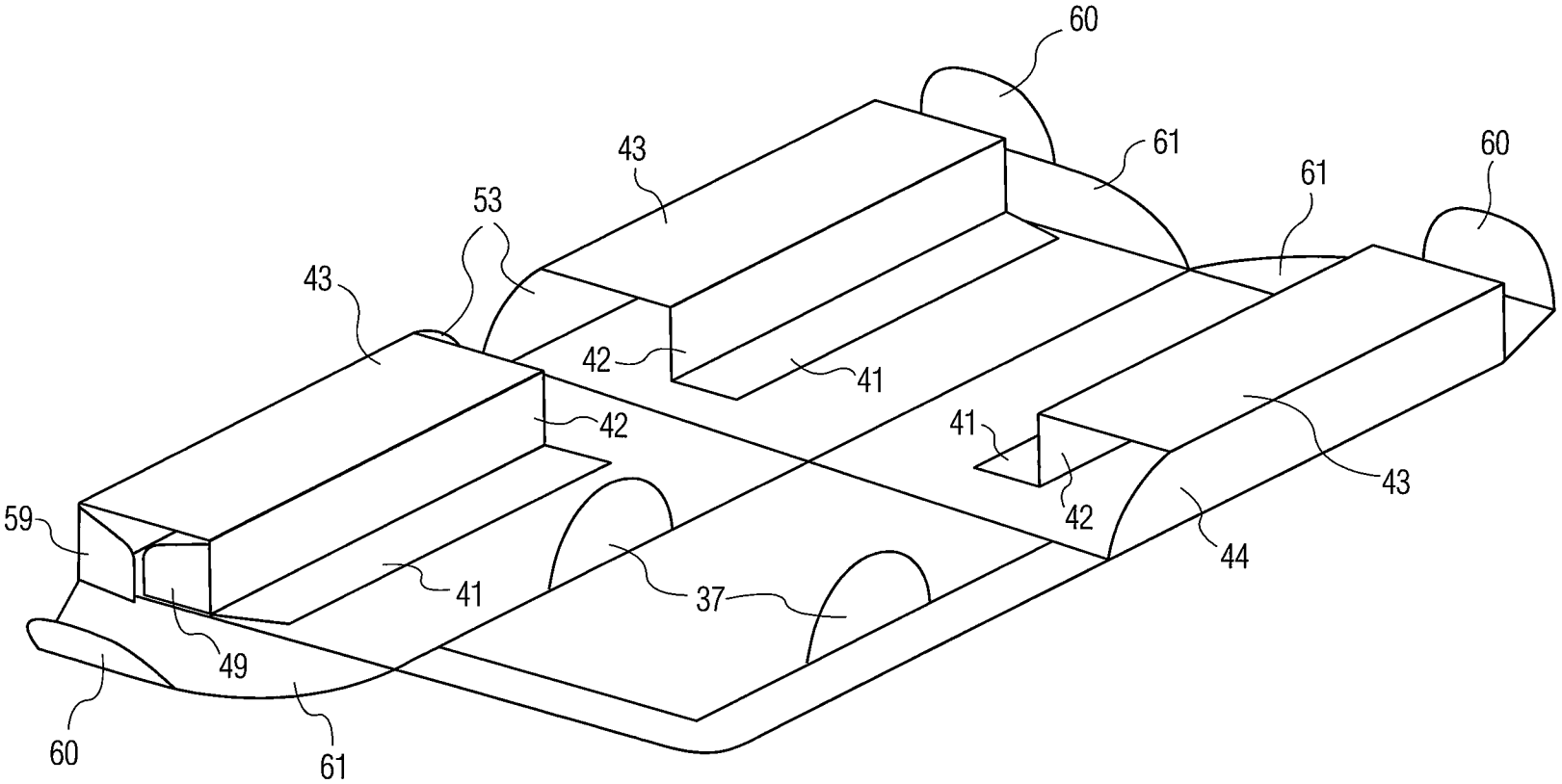
FIG. 5 illustrates a perspective view of the blank of FIG. 3 during a further stage of assembly into an insert.

Next, as indicated in FIG. 5, the hemispherical component 60 of each flap 55, 57 Is folded inwardly and inserted between the folded-in tabs 49, 51 and horizontal section 43 of the integrated cartons 46, 47, 48. At the same time, the remainder of the flaps 55, 57 are folded upwardly 90° relative to the main section 32.

With a suitable glue of either or both of the tabs 49, 51 and flaps 55, 57, the flaps 55, 57 are secured to the tabs 49, 51 to thereby close off an otherwise open end of the respective integrated carton 46, 47, 48 and provide stability to each integrated carton 46, 47, 48 while forming the insert (tray) 61. The flaps 55, 57 also impart a degree of rigidity to the integrated cartons 46, 47, 48 and reduce the risk of crushing of the integrated cartons 46, 47, 48 during use of the insert 62.

By way of example, the dimensions of the blank 31 are as follows:

- rectangular components 33, 34—length 6.000 inches, width 9.500 inches
- outermost section 41—length 4.0 inches, width 0.625 inches
- section 42—length 4.0 inches, width 0.625 inches
- section 43—length 4.0 inches, width 0.625 inches
- innermost section 42—length 0.625 inches, width 0.625 inches
- tabs 40, 51—length 0.641, width 0.625 inches
- gussets 53—length 4.75 width 0.625 inches
- flaps 55, 57—length 3.00 inches In this embodiment, the fabricated insert 62 with an item (not shown) placed in the respective opening 35 is placed into a pocket of a paper envelope of standard or an expandable construction, as described in U.S. Pat. No. 6,227,444, to create a package providing a uniform over all thickness.

Of note, the blank 31 for making the insert 62 may have perforations in place of the fold lines to allow for flexibility.

In each embodiment of FIGS. 2 and 6, the fabricated insert 30, 62 is characterized in being flexible. While score lines 12, 33 are shown, the score lines are not required to make the package flexible. Sections of the tray comprised of integrated cartons or sleeves are not flexible. The spaces between the integrated cartons or sleeves are flexible due to the flexible nature of a single ply of paperboard.

In each embodiment, once an insert 30, 62 is fabricated, an item (not shown) may be placed in the respective opening 14, 35 and the loaded insert placed into a pocket of a paper envelope of standard or an expandable construction, as described in U.S. Pat. No. 6,227,444, and a flap of the envelope can be folded over to close the pocket. In each embodiment, the insert 30, 62 is of a height and width to substantially fill the pocket. Alternatively, the insert 30, 62 and the item may be inserted in a sleeve, plastic bag, shrink-wrapped in plastic, or wrapped with a web of paper or plastic or the like to form the package for mailing purposes.

The inserts described above may be used to ship various types of items. Loose goods, such as jewelry, or other small items, may be contained within a carton that is then placed in the insert. Other items, such as razor cartridges, or a mobile phone case may not require to be placed in a carton and may simply rest within the recess of the insert. The combination of die cut shapes, glued areas, and structural tabs allows a single sheet to be quickly assembled into a structurally sound three-dimensional insert or tray.

Figure 7:
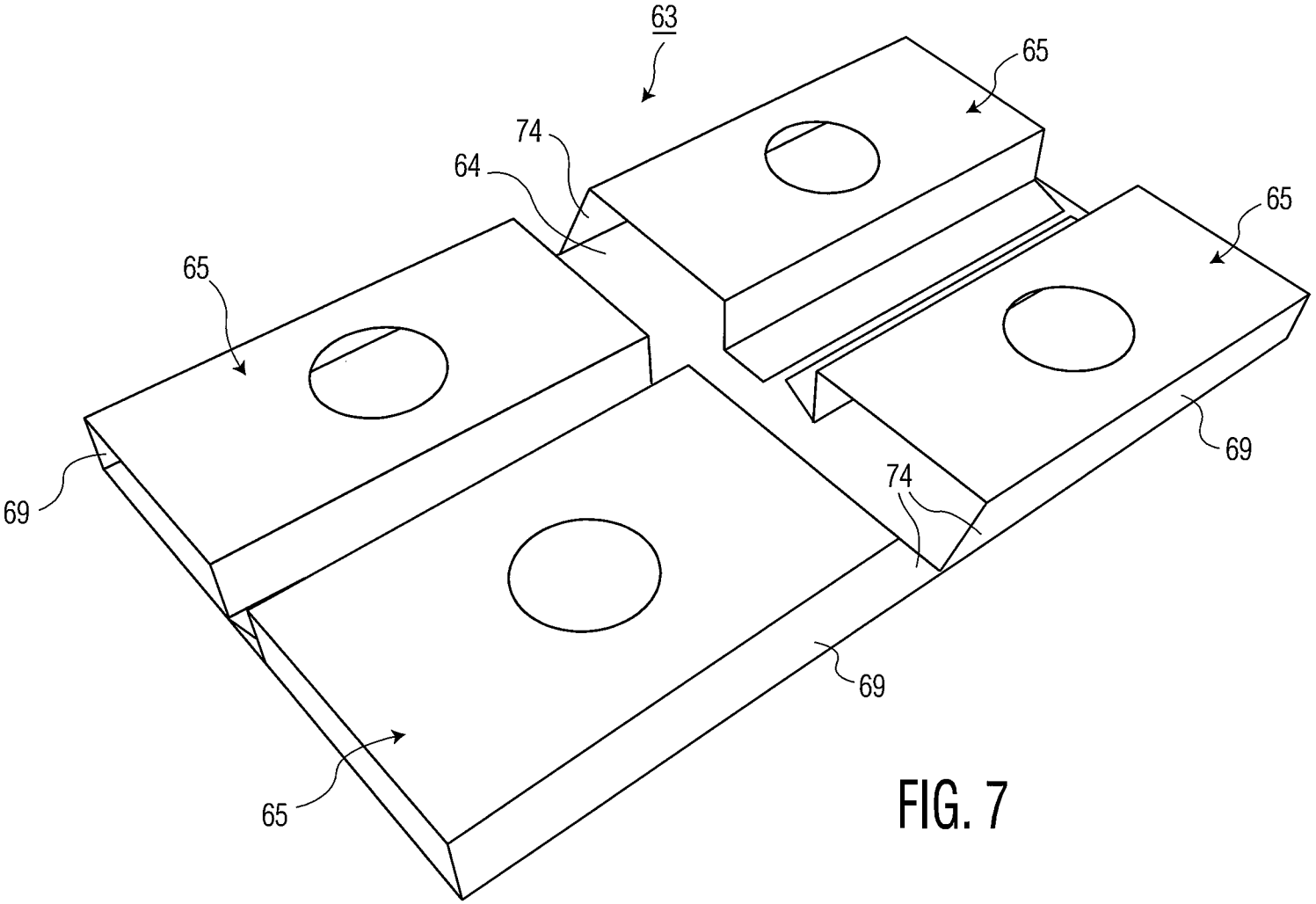
FIG. 7 illustrates a perspective view of an insert with spacers in accordance with the invention.

Referring to FIG. 7, the insert 63, i.e. a tray, for an envelope is of one-piece construction, for example, of corrugated fiberboard, of paperboard or other suitable material.

As illustrated, the insert 63 has a flat main section 64 and four spacers 65 integral with and overlying said main section 11.

The flat main section 64 serves as the bottom of the insert 63 and is of rectangular shape for readily sliding into an envelope of suitable construction for mailing as a "flat" under US Postal regulations.

Each spacer 65 is of rectangular shape to form a sleeve and is open at each end to receive goods that are to be mailed or shipped. Each spacer 65 is kept upright by the goods (not shown) received therein, i.e. the spacers are not self-supporting.

Figure 8:
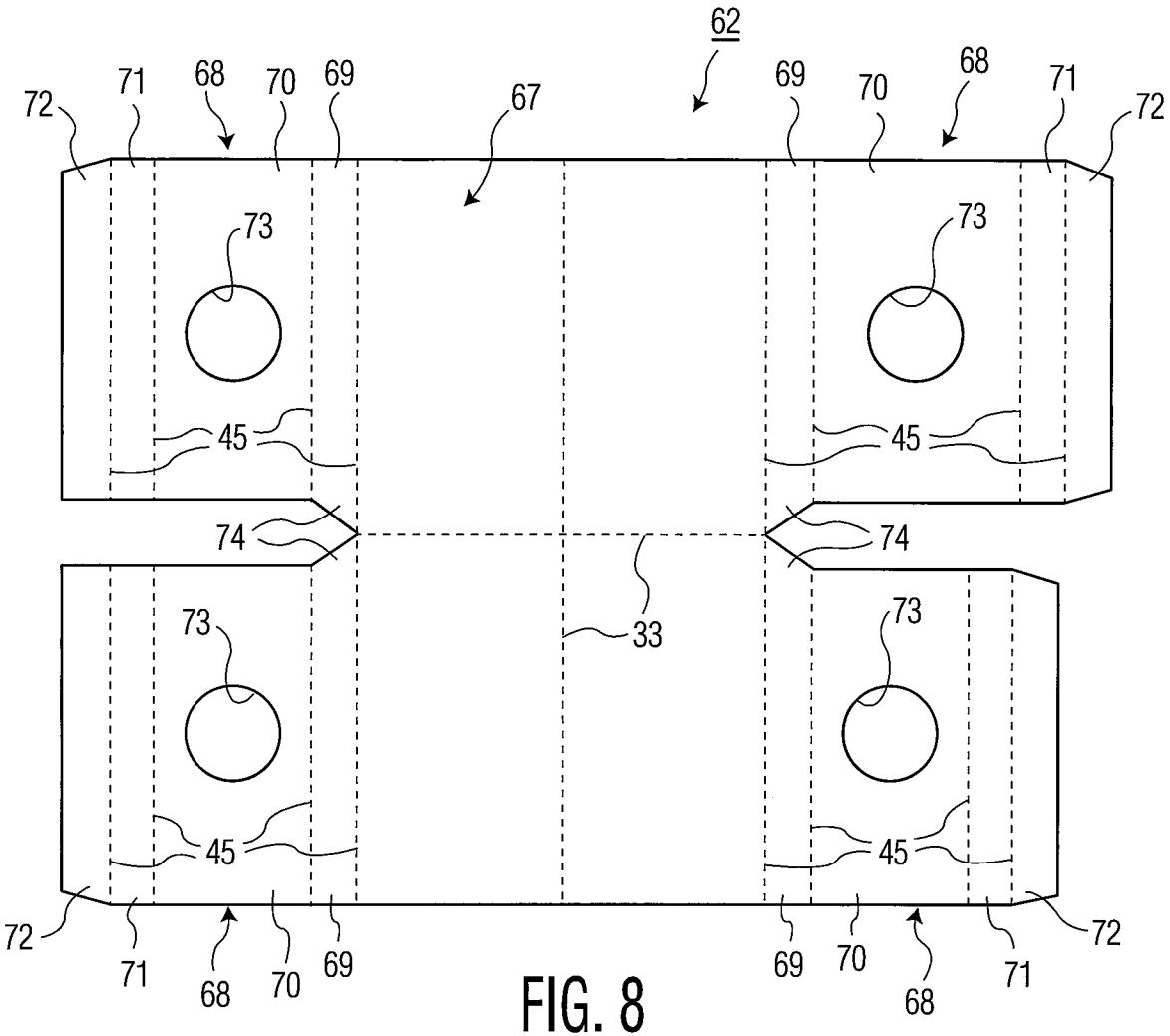
FIG. 8 illustrates a view of a blank for making the insert of FIG. 7.

Referring to FIG. 8, the blank 66 for making the insert 63 is of one-piece construction of paperboard, for example, of a thickness of 0.625 inches.

The blank 66 includes a main section 67 of rectangular shape and four extensions 68. The main section 67 may be optionally provided with a pair of fold or score lines (not shown) at right angles to each other to separate the main section 67 into four quadrant components.

Figure 18:
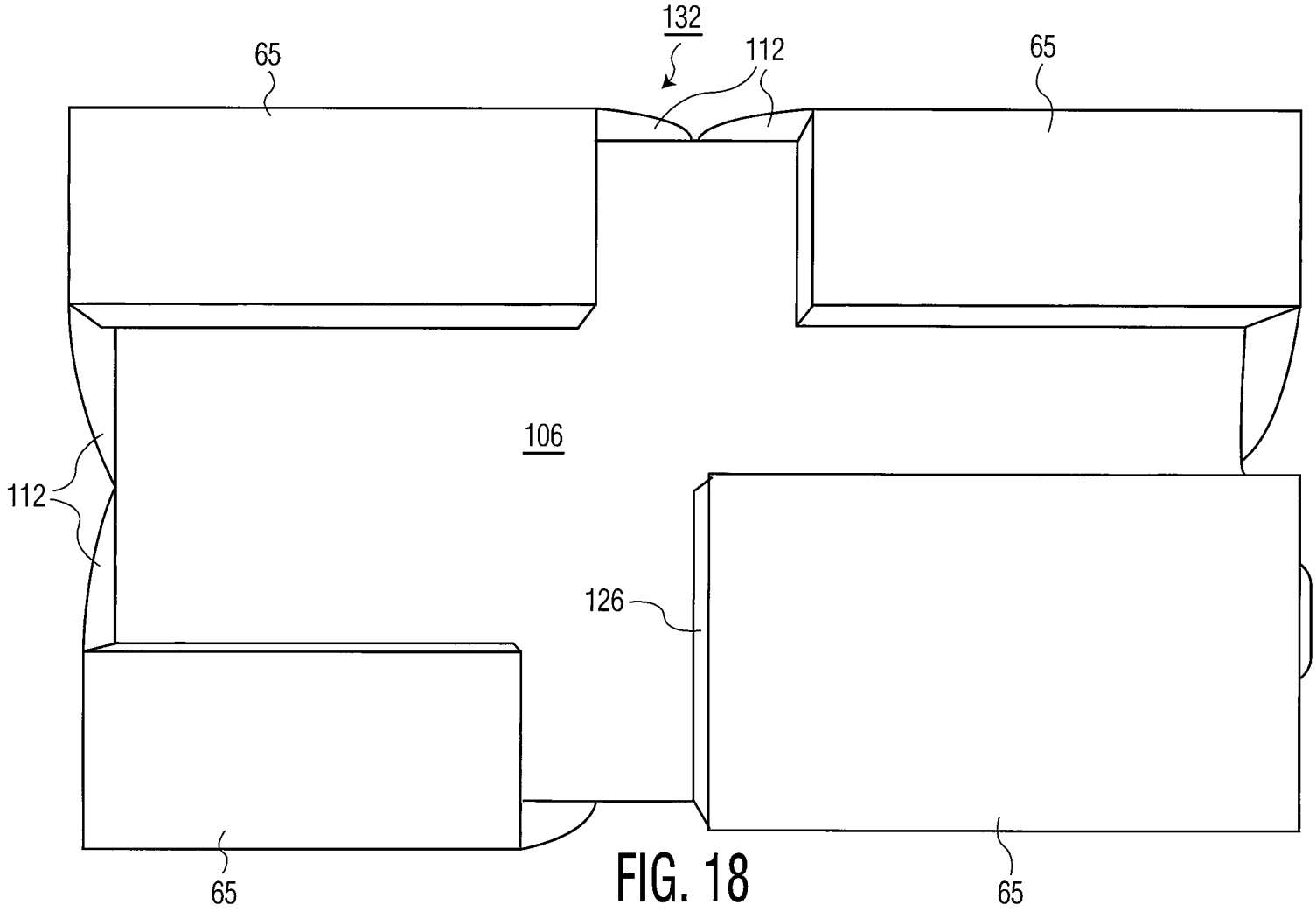
FIG. 18 illustrates a pictorial view of an insert made with the blank of FIG. 17.

Each extension 68 has four sections 69, 70, 71, 72. The first section 69 extends from the main section 67 to be folded in perpendicular relation thereto as shown in FIG. 7. The second section 70 extends from the first section 69 to be folded into parallel with the main section 67 (FIG. 7). The third section 71 extends from the second section 70 to be folded into perpendicular relation to the main section 67 (FIG. 7). The fourth section 72 extends from the third section 71 to be folded flat against and secured to the main section 67 as by an adhesive. The fourth section 72 may be folded outwardly of a spacer 65 (FIG. 7) or inwardly of the spacer 65 (FIG. 18).

When the sections 69, 70, 71, 72 of each extension 68 of the blank 66 are folded as described, each extension 68 forms a spacer 65.

As illustrated in FIG. 8, each extension 68 has a circular opening 73 in the second section 70 so that when folded into a spacer 65, the opening 73 provides visual access to the contents, if any, in the spacer 65.

As illustrated in FIG. 8, by way of example, the blank 64 has the following dimensions:

- the main section 67 has a width of 5.50 inches and a height of 9.875 inches;
- each extension 68 has a height of 4.5 inches;
- three extensions 68 have a width of 3.969 inches and the fourth extension has a width of 4.594 inches.

The sections 69, 70, 71, 72 of three shorter extensions 68 have a width dimension of 0.625, 0.594, 2.125 and 0.625, respectively. The sections 69, 70, 71, 72 of the wider extension 68 have a width dimension of 0.625, 0.594, 2.750 and 0.625, respectively. Thus, when the extensions 68 are folded into the spacers 65, one spacer 65 has a wider surface and opening than the other spacers 65.

As illustrated in FIG. 8, the first section 69 of each extension 68 has a triangular portion 74 facing an opposite extension. When the extensions 68 are folded, the triangular portions 74 serve to create a space between opposed spacers 65 and form a V-shaped gap therebetween to allow for flexing of the insert 63.

As illustrated in FIG. 8, the fourth section 72 of each extension 68 may be of trapezoidal shape or with one angled edge and one straight edge for manufacturing purposes.

As described, the four spacers 65 are designed to receive goods of similar thickness. In this embodiment, the goods placed within the four spacers support the structure to create a uniform thickness throughout.

Alternatively, assembled trays containing goods within one, two, or three of the four quadrants may include a blank (not shown) of paperboard, corrugate, foam, plastic or other similar material placed in one or more sleeve quadrants not containing goods.

Figure 9:
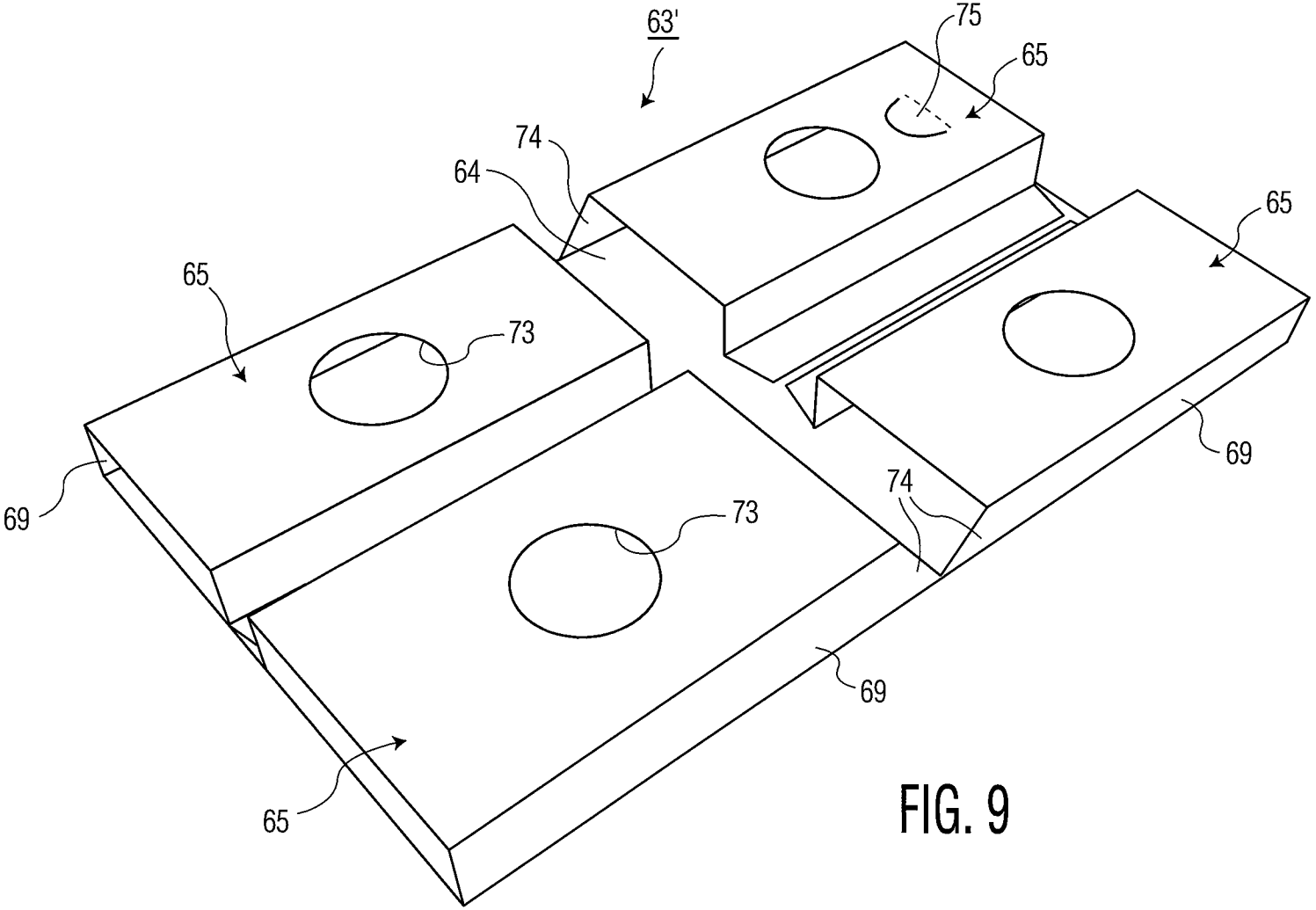
FIG. 9 illustrates a perspective view of a modified insert with spacers in accordance with the invention.

Referring to FIG. 9, wherein like reference characters indicate like parts as above, one or more spacers 65 of the insert 65' may be provided with a tuck-in-tab 75 that allows for the spacer 65 to remain empty without inserted goods. In use, the tab 75 would be deflected into perpendicular relation to the main section 67.

Figure 10:
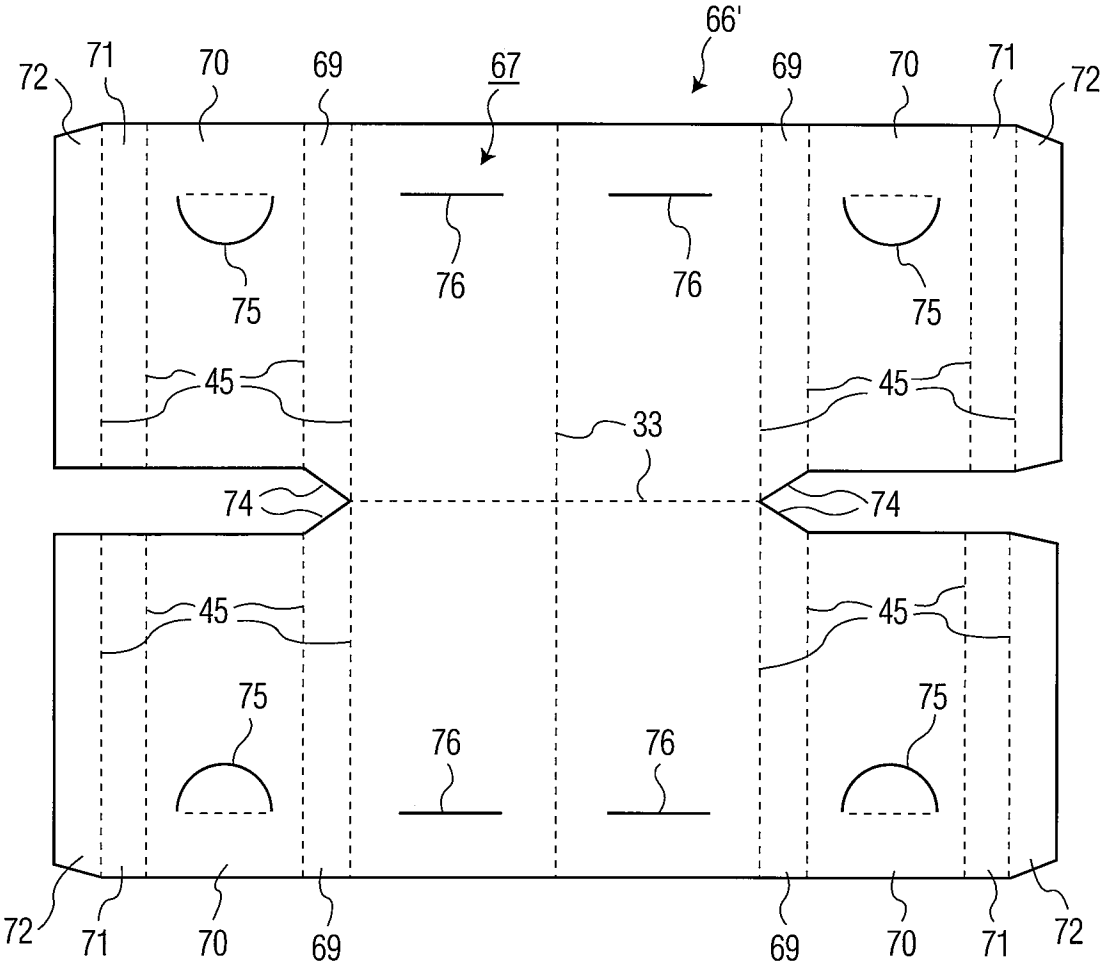
FIG. 10 illustrates a view of a blank for making the insert of FIG. 9.

Referring to FIG. 10, wherein like reference characters indicate like parts as above, the blank 66' for making the insert 63' has a tuck-in-tab 75 in the second section 70 of each extension 68 and a slit 76 in each quadrant of the main section 67 for receiving a tab 75. As illustrated, each tab 75 is of semi-circular shape.

When each extension 68 is folded into a spacer 65, the tab of each extension 68 is inserted into a matching slit 76 in the main section 67 thereby causing the second section 70 that is otherwise parallel to the main section 67 to deflect into an arched shape. At the same time, the quadrant of the main section 67 also deflects towards the second section 70.

When the tab 75 is interlocked, the spacer 65 becomes arched, creating a self-supporting 3-dimensional structure designed to create overall uniform thickness of the finished package. The tabs 75 and slits 76 may be positioned in one, two, or three of the four spacers to allow goods to be placed in those spacers that are not interlocked.

Figure 11:
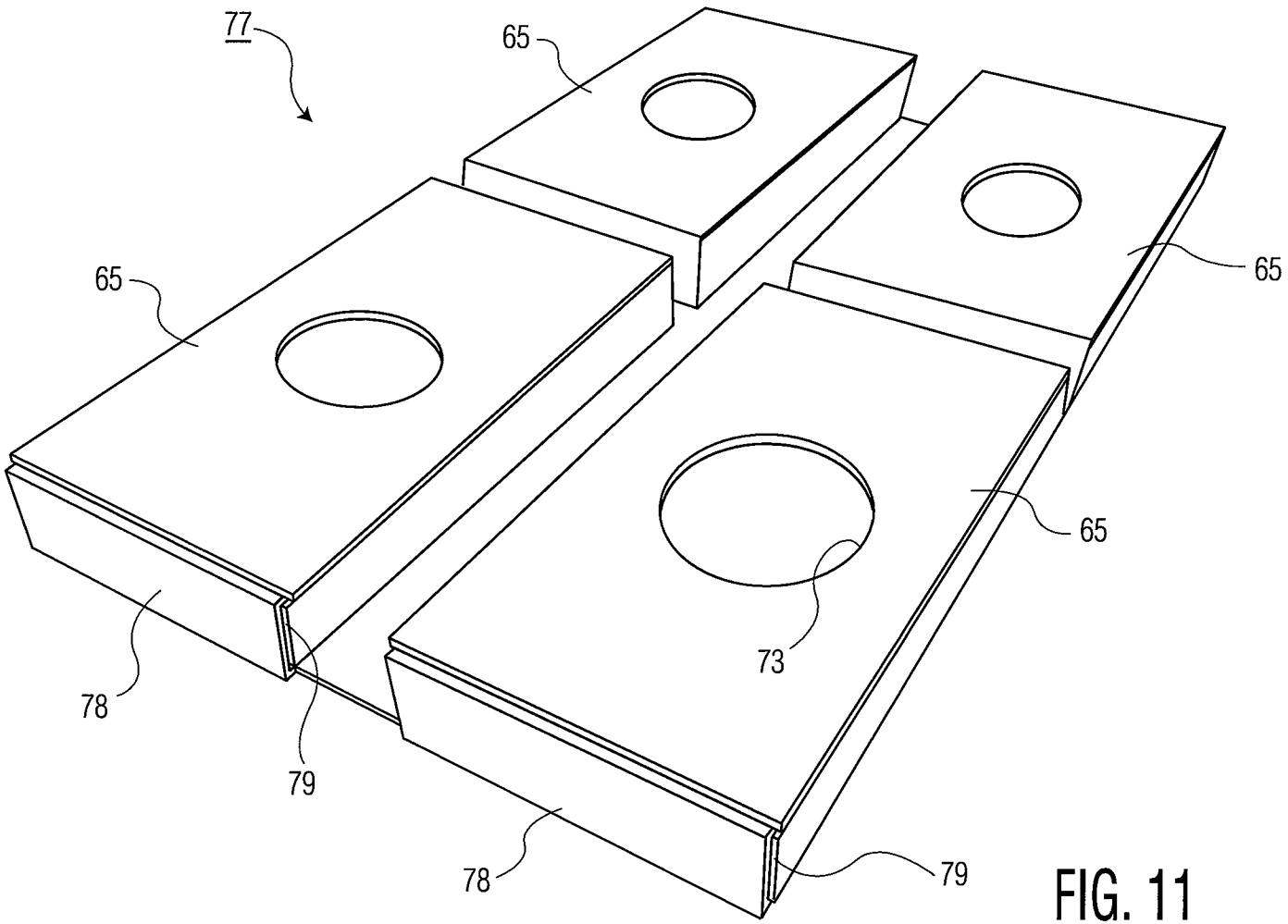
FIG. 11 illustrates a perspective view of a further modified insert with spacers in accordance with the invention.

Referring to FIG. 11, wherein like reference characters indicate like parts as above, the insert 77 is provided with closure flaps 78 (not shown) and dust flaps 79 on the outer ends of the spacers 65 to make the spacers 65 self-supporting. In this way, the spacers 65 can be filled with goods or can be empty creating a package that is uniformly thick.

Figure 12:
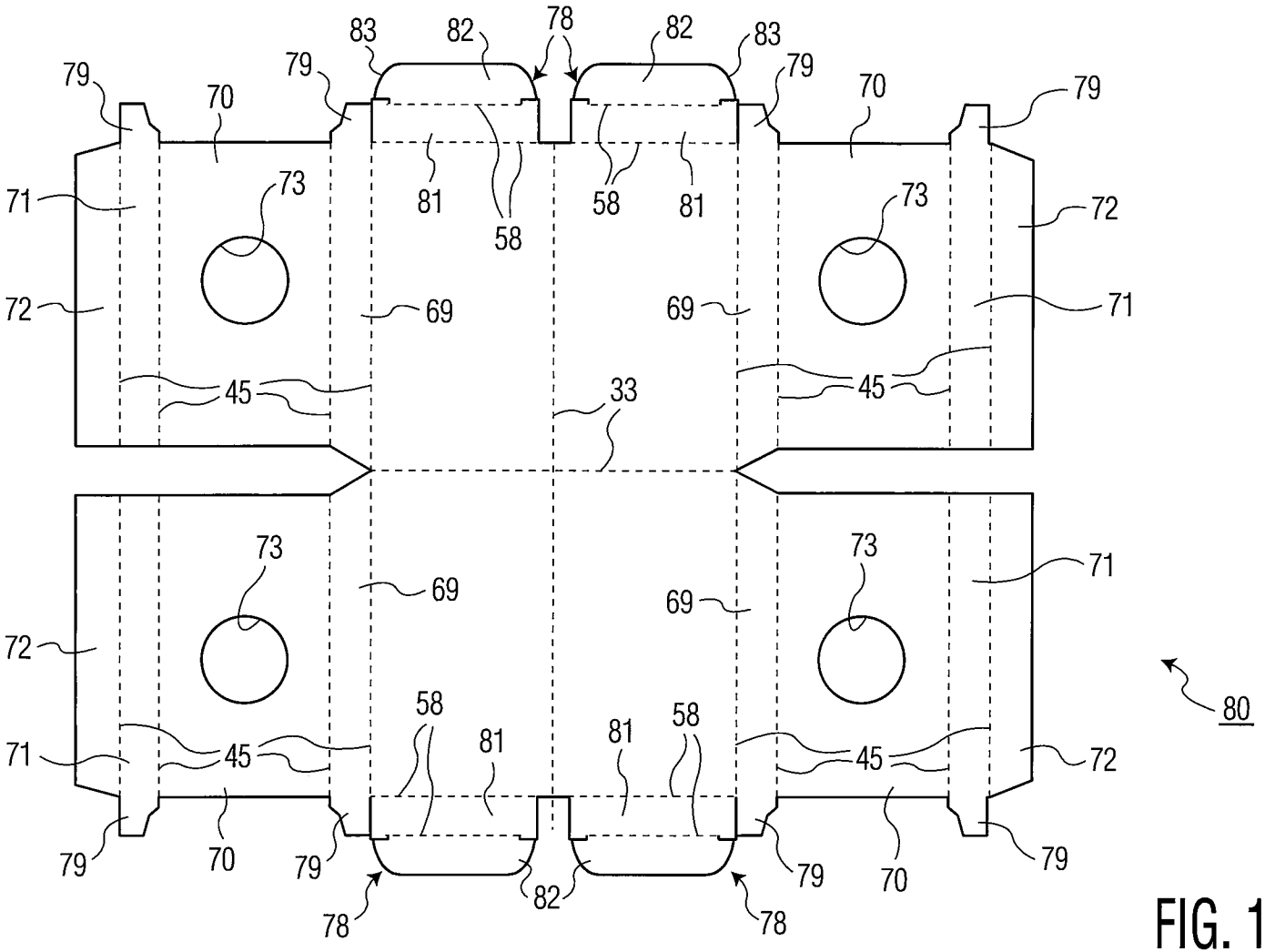
FIG. 12 illustrates a view of a blank for making the insert of FIG. 11.

Referring to FIG. 12, wherein like reference characters indicate like parts as above, the blank 80 for making the insert 77 includes a pair of closure flaps 78 extending from each end of the main section 67. As indicated, the flaps 78 are of similar shape with a rectangular component 81 and a component 82 with two rounded corners 83.

The blank 80 also includes a pair of dust flaps 79 extending from each extension 68. As indicated, one dust flap 79 extends from one end of the first section 69 and the second dust flap 79 extends from one end of the third section 71.

When the blank 80 is folded into the insert 77 (FIG. 11), the dust flaps 79 are folded perpendicularly of the spacers 65 to partially close off the interior of the spacers 65 and then the closure flaps 78 are folded up to cover the dust flaps 79. In addition, the component 82 of each closure flap 78 is folded in to slide between the dust flaps 79 and the second section 70 of the extension 68 thereby closing off the end of the spacer 65.

The dust flaps 79 and closure flaps 78 prevent the spacers 65 from collapsing by being positioned on the ends of each of the spacers 65 creating a carton enclosed on three sides, with one open end, or enclosed on all four sides. The resulting insert 77 creates a self-supporting structure whereby goods can be inserted into one, two, three, or all four quadrants creating a package that is uniformly thick.

Figure 13:
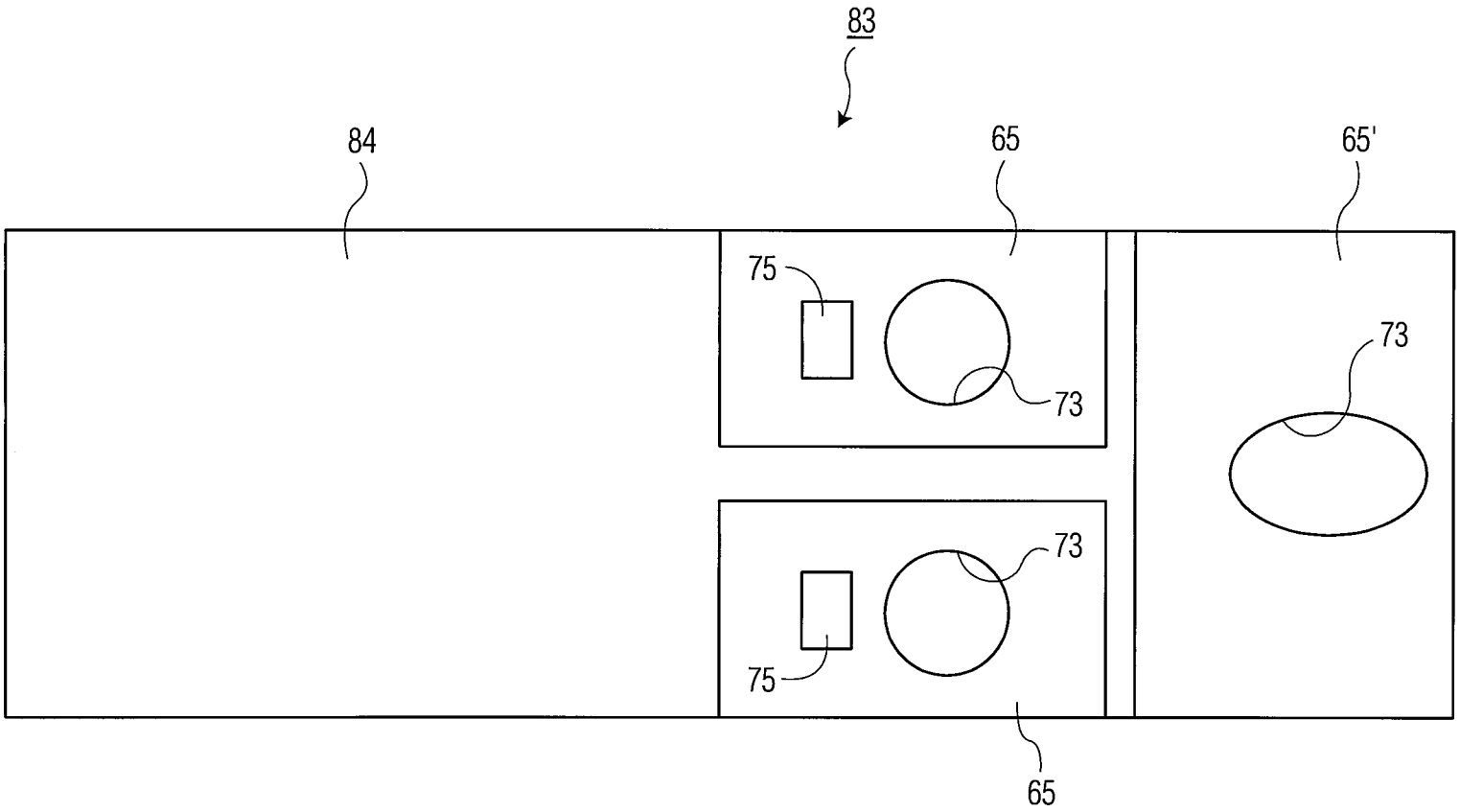
FIG. 13 illustrates a perspective view of an insert with a cover for folding over a plurality of spacers of the insert in accordance with the invention.

Referring to FIG. 13, wherein like reference characters indicate like parts as above, the insert 83 has two smaller spacers 65 created to receive rigid or non-rigid goods within one or both spacers 65, along with one larger spacer 65' created to receive literature, or other non-rigid goods. Similar to previously described spacers, these spacers 65 may be enclosed on three or four sides with the addition of a tuck in closure flap 78 and dust flaps 79 or include integrated fold in flaps (not shown) that interlock to prevent the spacer 65 from collapsing.

In instances where a spacer 65 is not filled, there a press-in locking tab 75 is provided to support the empty structure.

This insert 83 also has an integrated fold over flap 84 to be used for marketing promotions. This fold over flap could be designed into each of the above mentioned paperboard embodiments.

Figure 14:
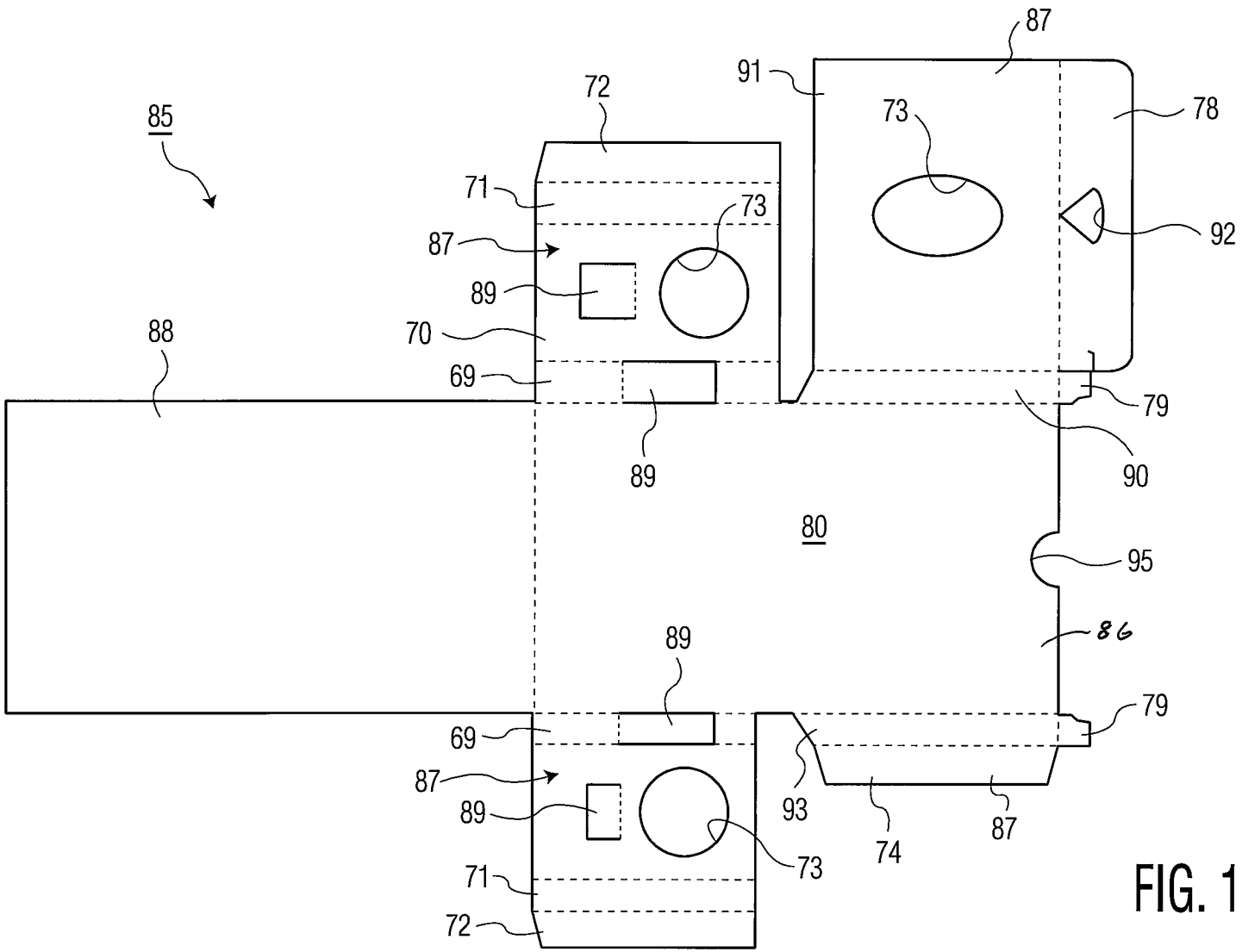
FIG. 14 illustrates a view of a blank for making the insert of FIG. 13.

Referring to FIG. 14, wherein like reference characters indicate like parts as above, the blank 85 for making the insert 83 includes a main section 86 with four extensions 87 for forming the spacers 65, 65' and an extension 88 for forming the fold over flap 84.

Two of the extensions 87 are constructed as indicated in FIG. 8 and include a pair of tabs 89 that can be pressed in when the insert 83 is formed to support an empty spacer 65.

A third extension 87 is formed of a first section 90 that extends from the main section 86 to be folded in perpendicular relation thereto and a second section 91 that extends from the first section 90 to be folded into parallel with the main section 86. In addition, the third extension 87 includes a closure flap 78 extending from the second section 91 with a central opening 92 and a dust flap 79 extending from the first section 90. The opening 92 is to allow the closure flap 78 to bend when the entire tray is flexed, to comply with USPS requirements.

The fourth extension 87 is formed of a first section 93 that extends from the main section 86 to be folded in perpendicular relation thereto and a second section 94 that extends from the first section 93 to be folded into parallel with the main section 86. In addition, a dust flap 79 extends from the first section 93.

The extension 88 for forming the fold over flap 84 extends from the main section 86 and is of rectangular shape with the same width as the main section 86.

When the blank 85 is folded to form the insert 83, the extensions 87 with the tabs 89 are folded to form two similar spacers 65 on opposite sides of the insert 83. If the spacers 65 are to remain empty, the tabs 89 are folded inwardly 90° to abut the main section 86 and thereby support the spacer 65 against collapse. The remaining two extensions 87 are also folded over the main section 86 to overlap and be secured as by adhesive to each other and to form the wider spacer 65' for receiving literature or other goods.

Referring to FIG. 14, the main section 86 may also be provided with a centrally located recess 95 to serve as a thumb cutout in the insert 83 (FIG. 13) to allow for easier opening of the closure flap 78 to access contents.

Figure 15:
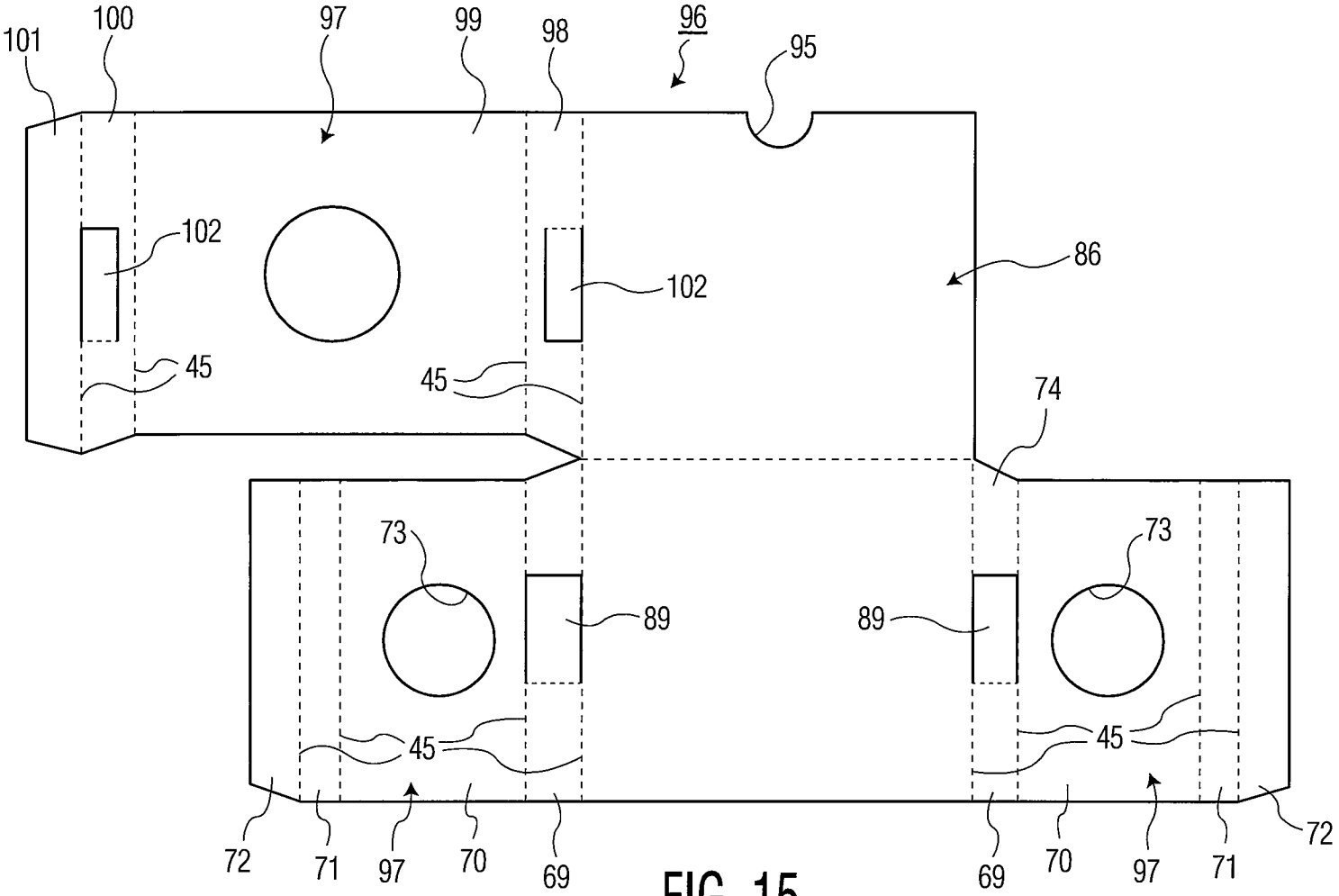
FIG. 15 illustrates a view of a blank for making the insert of FIG. 13 without a cover.

Referring to FIG. 15, wherein like reference characters indicate like parts as above, the blank 96 may be used to make an insert (not shown) similar to the insert of FIG. 13 without the fold over flap 84.

In this embodiment, the blank 96 includes a main section 86 with three extensions 97 for forming three spacers 65, 65'. Two of the extensions 97 are constructed as indicated in FIG. 8 and include a tab 89 that can be pressed in when an insert is formed to support an empty spacer 65. The third extension 97 is formed of a first section 98 that extends from the main section 86 to be folded in perpendicular relation thereto, a second section 99 that extends from the first section 98 to be folded into parallel with the main section 86, a third section 100 that extends from the second section 99 to be folded into perpendicular relation to the main section 86 and a fourth section 101 that extends from the third section 100 to be folded inwardly flat against and secured to the main section 86 within the spacer 65'.

In addition, the third extension 97 has a pair of tabs 102 located in the first and third sections 98, 100 for folding inwardly to provide support to the spacer formed by the extension.

The blank 96 may also have a single vertical score (not shown) and a single horizontal score (not shown) running through the center of the blank 96 to assist the Insert (tray) in flexing.

Also, where the two smaller spacers 65 are designed to receive razor cartridges, the blank 96 may be perforated so that the "spacers" tear out from the insert (tray) to become a protective covering for the razors.

Figure 16:
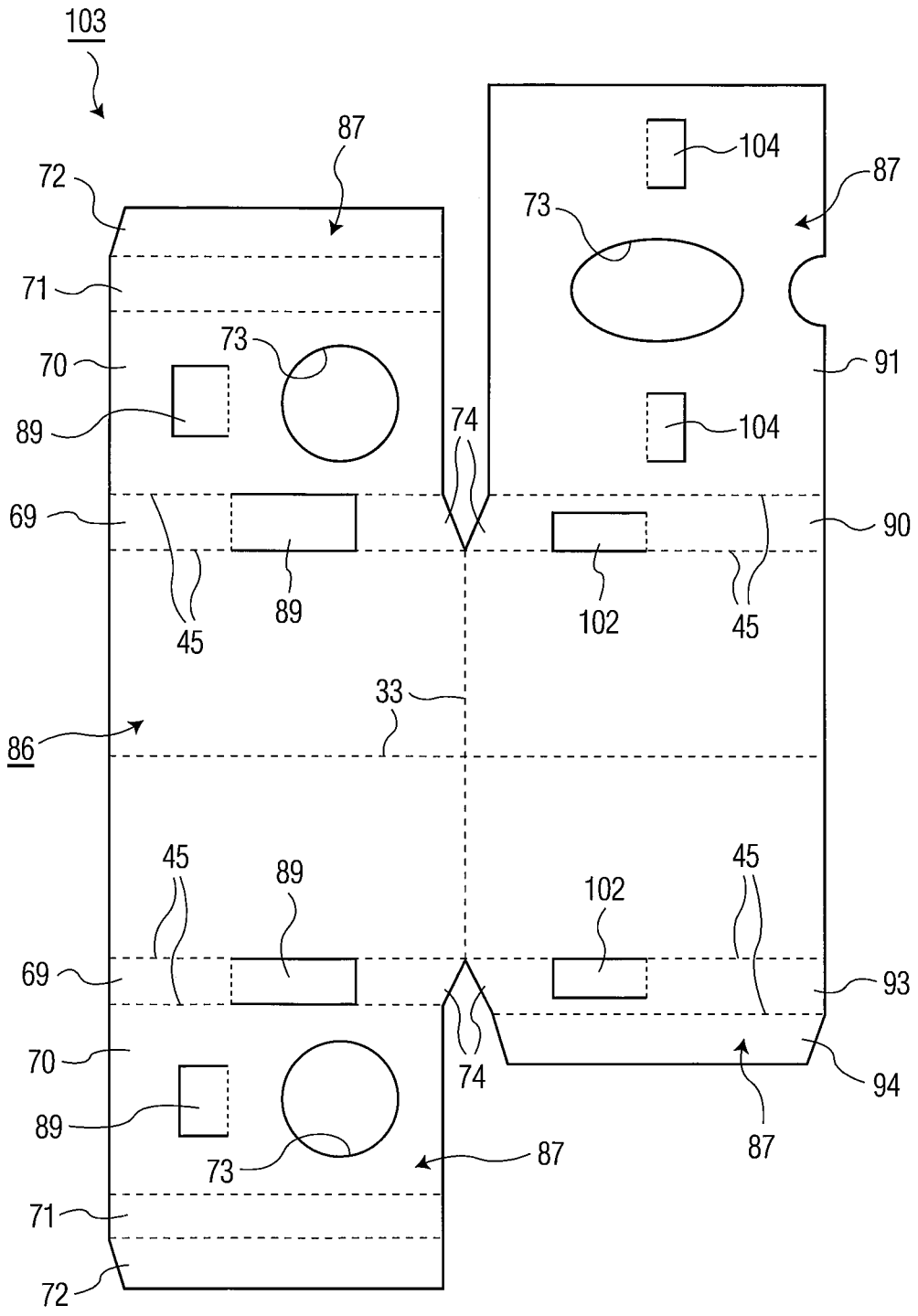
FIG. 16 illustrates a view of a blank for making a modified insert of FIG. 13.

Referring to FIG. 16, wherein like reference characters indicate like parts as above, the blank 103 may be used to make an insert (not shown) similar to the insert of FIG. 13 without the fold over flap 84.

In this embodiment, the blank 103 is similar to the blank 85 of FIG. 14 but without the closure flaps 78 and dust flaps 79.

The blank 103 includes tabs 89 in each of the first sections 69 of the extensions 87 for folding into a spacer 65 (not shown) when the blank 103 is formed into an insert (not shown) for supporting the resultant spacers 65.

The blank 103 also includes two tabs 104 in the second section 91 of the extension 87 for forming the wider spacer 65' for folding into the wider spacer 65' (not shown) when the blank 103 is formed into an insert (not shown) for supporting the wider spacer 65'.

Figure 17:
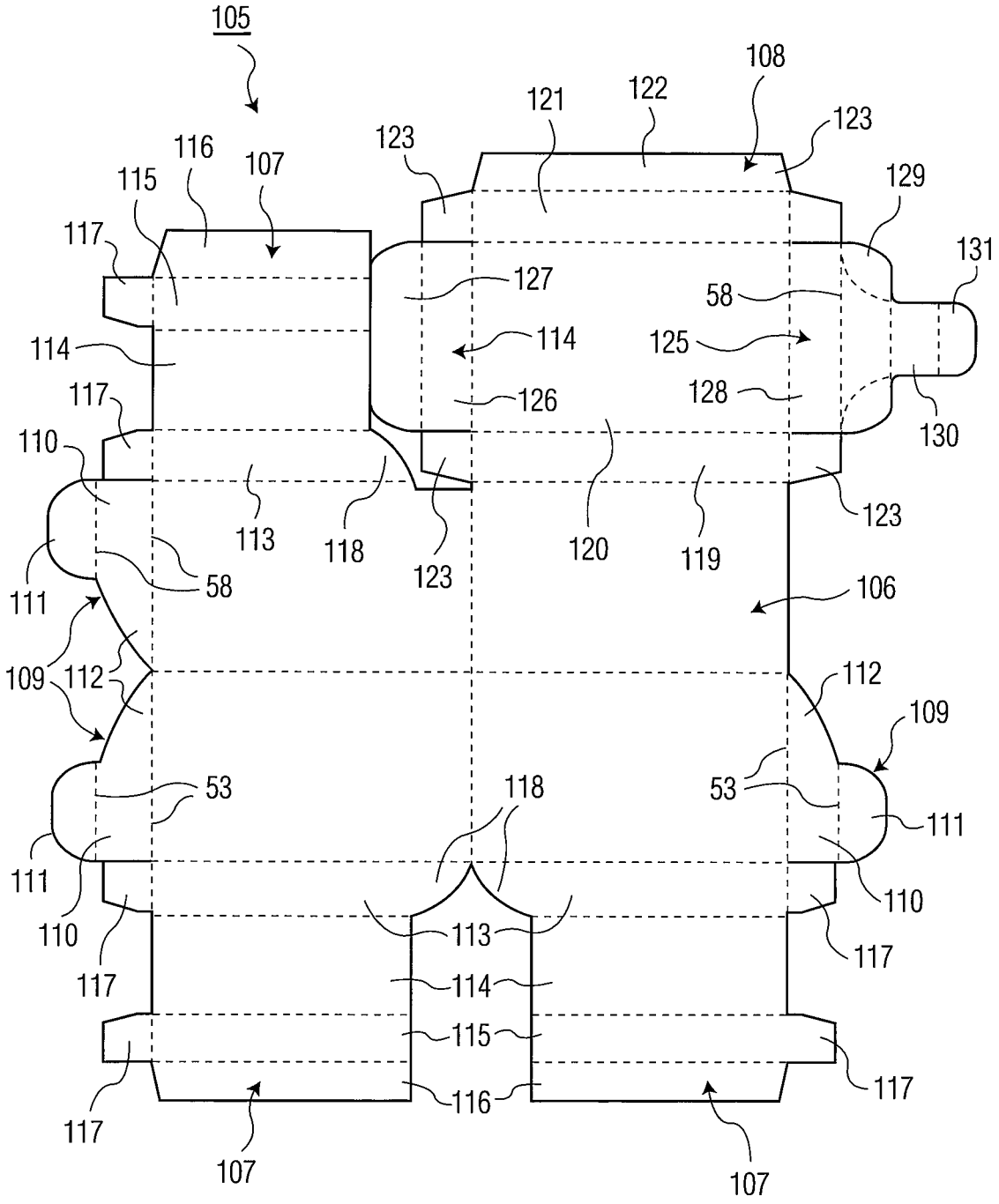
FIG. 17 illustrates a view of a blank for making a further modified insert.

Referring to FIG. 17, wherein like reference characters indicate like parts as above, the blank 105 is constructed to make an insert (not shown) that is similar to the insert 62 illustrated in FIG. 6.

The blank 105 includes a main section 106 and three extensions 107 of identical construction and a fourth extension 108 of different construction.

As illustrated, the main section 106 has a single flap 109 extending from one quadrant thereof and a pair of spaced apart flaps 109 extending from two other quadrants on the opposite side of the main section 106 being separated therefrom by lines of weakening.

As indicated, the flaps 109 are of similar shape with a rectangular component 110, a hemispherical component 111 and a triangular component 112 with a rounded hypotenuse.

Each extension 107 extends from a quadrant of the main section 106 and has four sections 113, 114, 115, 116 separated by fold lines or other lines of weakening, such as a cut/crease which is a combination of cuts and a crease to allow for easier folding, from each other and the main section 106.

The four sections 113, 114, 115, 116 of each extension 107 are sized to be assembled into an integrated spacer (not shown) along one edge of the main section 106 for the resultant insert.

The first section 113 and third section 115 of each extension 107 have a dust flap 117 extending therefrom from one side and the first section 113 of each extension 107 has a rounded gusset 118 extending laterally thereof opposite the dust flap 117.

The fourth extension 108 also has four sections 119, 120, 121,122 sized to be assembled into an integrated spacer (not shown) along one edge of the main section 106 of the resultant insert. As illustrated, the first section 119 has a dust flap 123 extending from each side and the third section 121 has a dust flap 123 extending from each side. The second section 121 which is to be folded into parallel with the main section 106 when forming an insert has a closure flap 114 extending from one side and a special flap 125 extending from the opposite side to serve as a pull tab for easy opening of the resultant insert (tray).

The closure flap 114 has a rectangular section 126 extending from the second section 121 of the extension 108 to be folded perpendicularly of the second section 121 and a rectangular section 127 with rounded corners extending from the first rectangular section 126 for insertion into a spacer by sliding along the main section 106 thereby closing off the end of the spacer.

The special flap 125 has a first rectangular section 128 extending from the second section 121 to be folded perpendicularly of the second section 121, a second rectangular section 129 with rounded corners to be folded into parallel with the main section 106 when forming an insert, a third rectangular section 130 of reduced width to be folded perpendicularly of the second section 129 and a fourth rectangular section 131 with rounded corners and reduced width to be folded perpendicularly of the third section 130.

Referring to FIG. 18, wherein like reference characters indicate like parts as above, when folded, the blank 105 forms an insert 132 with four spacers 65 (sleeves). As illustrated, two spacers are of the same size, one spacer 65 is shorter in length and one spacer 65 is longer and wider. This allows the insert 132 to receive goods of different lengths and widths.

Figure 19:
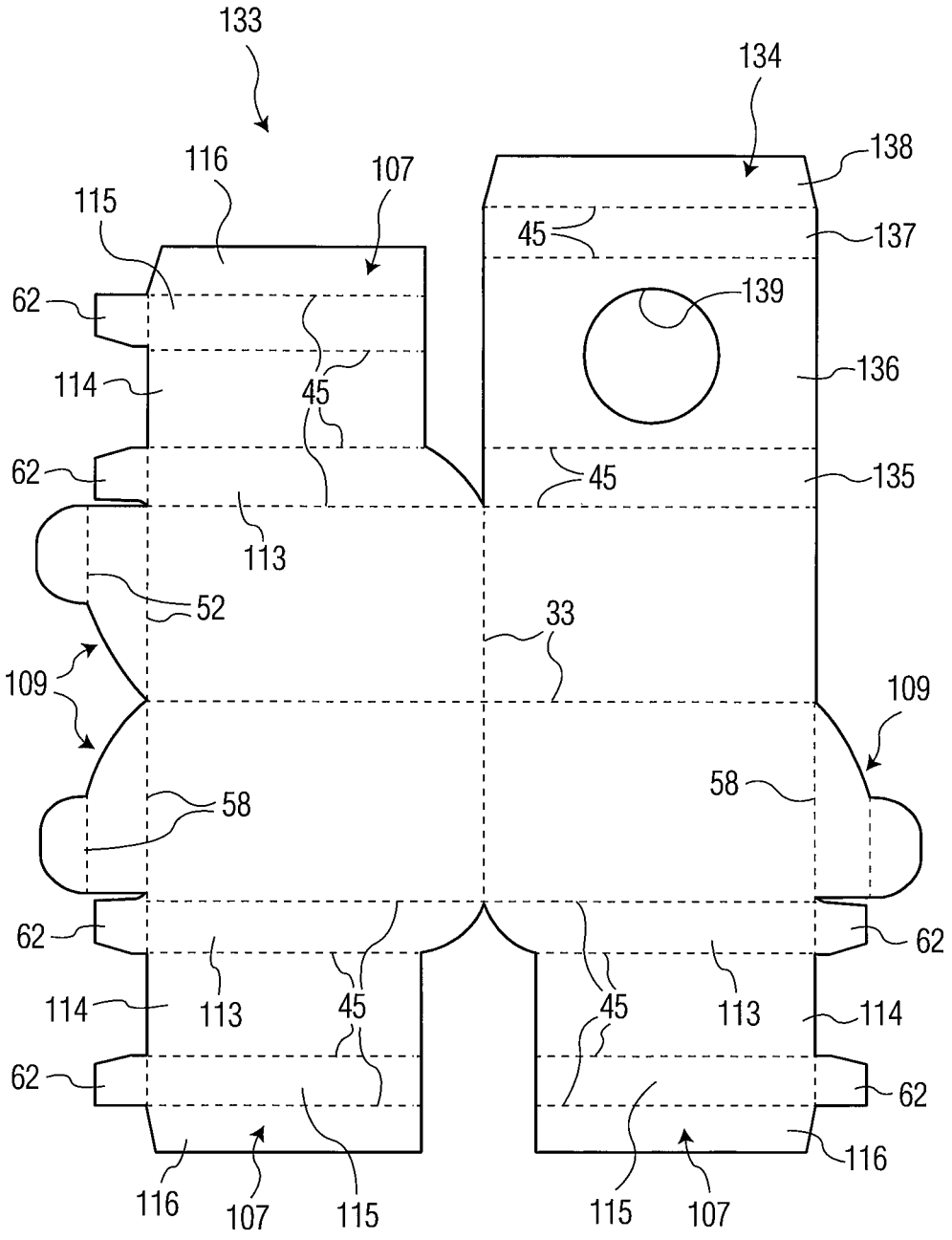
FIG. 19 illustrates a view of a blank for making a modified insert of FIG. 17.

Referring to FIG. 19, wherein like reference characters indicate like parts as above, the blank 133 is constructed to make an insert (not shown) that is similar to the insert 132 illustrated in FIG. 18.

In this embodiment, the blank 133 includes a main section 106 and three extensions 107 of identical construction and a fourth extension 134 of different construction.

Each extension 107 extends from a quadrant of the main section 106 and has four sections 113, 114, 115, 116 separated by fold lines or other lines of weakening, such as a cut/crease which is a combination of cuts and a crease to allow for easier folding, from each other and the main section 106. The four sections 113, 114, 115, 116 of each extension 107 are sized to be assembled into an integrated spacer (not shown) along one edge of the main section 106 for the resultant insert.

The fourth extension 134 also has four sections 135, 136, 137, 138 sized to be assembled into an integrated spacer (not shown) along one edge of the main section 106 of the resultant insert. The second section 136 includes a cut-out 139 to permit viewing of the contents of the spacer (not shown) formed by the folded extension 134.

In the embodiments of FIGS. 1 to 19, the main section of each blank, may be provided with horizontal and vertical perforations about one or more of the spacers 65 so that a spacer 65 filled with a good, such as a razor cartridge, along with a part of the main section, may be torn out from the insert to become a protective covering for the razor cartridge.

Referring to FIG. 20, wherein like reference characters indicate like parts as above, the blank 135 is made with a main section 136 of rectangular shape and three extensions 137, 138, 139 which are to be folded under the main section 136.

The main section 136 is of rectangular shape and is provided with a vertical fold line 140 and a horizontal fold line 141.

In addition, the main section 136 includes four elongated cut-outs 142 for example, of elliptical shape. Each cut-out 142 is bordered by a plurality of slits 143 so that tabs 144 may be formed about the cut-out 142.

Two identical extensions 137, 138 extend from opposite ends of the main section 136 and each is formed of two sections 145, 146 and each extension has a centrally located shaped opening 147. The first section 145 is foldable downwardly, as viewed, into perpendicular relation to the main section 136 and the second section 146 is foldable into parallel relation to the main section 136.

The larger extension 139 extends from one side of the main section 136 and has four sections 148, 149,150, 151 separated by fold lines or other lines of weakening and a pair of openings 147.

The four sections 148, 149, 150, 151 of the extension 139 are sized to be assembled into an integrated spacer (FIG. 21) under the main section 136, as viewed, for the resultant insert.

The first section 148 and third section 150 of extension 139 have a dust flap 79 extending therefrom from each end.

Referring to FIGS. 21 and 22, in order to form an insert 152, the three extensions 137, 138, 139 are folded under the main section 136, as viewed in FIG. 21 and secured thereto as by adhesive or glue. The resultant insert 152 is of box-shape and of a thickness determined by the size of the first section 148 and third section 150 of the extension 139.

When folded under and secured to the main section 136, the larger extension 139 extends across the width of the main section 136 to form a spacer or sleeve. In addition, the dust flaps 79 are folded into perpendicular relation to the sleeve. Each of the other sections 137, 138 extends across an end of the sleeve to close off the sleeve and the outer section 146 is tucked under the second section 149 of the larger extension 139.

Referring to FIG. 20, the openings 147 in the extension 139 serve as thumb holes for opening the insert 152.

Referring to FIG. 21, when ready for use, the tabs 144 are folded down in order to engage about a good (not shown) inserted in a cut-out 142.

The insert 152 is formed so that goods (not shown) may be inserted from outside the insert 152 and into the cut-outs 142 with the goods (not shown) supported on the main section 136 that underlies the cut-outs 142.

Referring to FIG. 23, wherein like reference characters indicate like parts as above, the blank 135' is similar to the main section 136 of the blank 135 of FIG. 20 and is of rectangular shape and is provided with a vertical fold line 140 and a horizontal fold line 141 as viewed.

In addition, the blank 135' includes four elongated cut-outs 142, for example, of elliptical shape that are disposed angularly of the blank 135'. Each cut-out 142 is bordered by a plurality of slits 143 so that tabs 144 may be formed about the cut-out 142.

Referring to FIG. 24, in use, after the blank 135' is folded into an insert 152', goods G are inserted into the cut-outs 142 to form a unit that may be slid into an envelope.

The embodiment of FIGS. 25 to 28 is directed to an insert 153 (FIG. 26) similar to the embodiment of FIG. 7 which is able to receive goods in cut-outs in the top side of the insert rather than being slid into sleeves of an insert.

Referring to FIG. 25, wherein like reference characters indicate like parts as above, the blank 154 for making the insert 153 has a main section 154 of rectangular shape and four extensions 155, 156 extending from the main section 154.

The main section 154 has four cut-outs 157, 158, three of which are of rectangular shape and one of oval shape. The three rectangular cut-outs 157 are each die cut to form tabs 159 that may be deflected inwardly when receiving a good (not shown) while the oval cut-out 158 is used for viewing contents under the cut-out or lack thereof.

Two extensions 155 on opposite sides of the main section 154 are identical and are sized to fold under the main section 154 to from sleeves. As viewed, each of these extensions 155 has four sections 160, 161, 162, 163 separated by fold lines 164 or other lines of weakening in order to be folded under the main section 154 to form a sleeve of rectangular cross-section. Each of these extensions 155 also has a pair of dust flaps 165 extending from the first and third sections 160, 162.

The other two extensions 156 are identical and are sized to fold under the main section 154 to form sleeves. These two extensions 156 also have four sections 160, 161,162, 163 separated by fold lines 164 or other lines of weakening in order to be folded under the remainder of the main section 154 to form a sleeve of rectangular cross-section. Each of these extensions 156 also has a pair of dust flaps 165 extending from the first and third sections 160, 162.

As illustrated, the first section 160 of the extensions 155 is of rectangular shape whereas the first section 160 of the other extensions 156 has a triangular portion facing the opposite extension 155 to allow for flexing of the completed insert 153 in half.

A pair of closure flaps 166 extends from each end of the main section 154. As illustrated, each closure flap 166 on the right-hand side of the main section 154 has a rectangular section 167 with a centrally located aperture 168 and a shaped end section 169 with a hemispherical cutout 170. The rectangular section 167 is sized to be equal to the height, as viewed, of the first section 160 of an adjacent extension 155, 156. Each closure flap 166 on the left-hand side of the main section 154 has a rectangular section 171 and a substantially rectangular end section 172. One of the rectangular sections 171 has a semi-circular cut-out 173.

In addition, each closure flap 166 has a pair of lock cuts 174 to prevent a closed sleeve end from opening in use.

Referring to FIGS. 27 and 28, in order to form an insert, the four extensions 155, 156 are folded under and secured as by adhesive to the main section 154 and each is further folded so that each extension 155, 156 forms a flattened sleeve with open ends. Thereafter, the dust flaps 165 of each extension are folded perpendicularly across an opening of each sleeve followed by folding of the closure flaps 166 across the dust flaps 165 and insertion of the ends of the closure flaps 166 into the sleeves over the dust flaps 165 to impart a rectangular cross-section to each sleeve.

Referring to FIG. 26, after formation of the sleeves, the tabs 159 within the three rectangular cut-outs 157 of the main section 154 are deflected inwardly The insert 153 is sized to receive goods within the rectangular cut-outs 157 and be slid into an envelope as described in U.S. Pat. Nos. 6,227,444 and 9,352,879 for shipment through the mails or otherwise.

The embodiment of FIGS. 29 to 33 is directed to an insert 175 (FIG. 30) similar to the embodiment of FIGS. 25 to 28 which is able to receive goods in cut-outs in the top side of the insert rather than being slid into sleeves of an insert.

Referring to FIG. 29, wherein like reference characters indicate like parts as above, the blank 176 for making the insert 175 has a main section 177 of rectangular shape and four extensions 178, 179,180,181 extending from the main section 177.

The main section 177 has two cut-outs 182, 183. One cut-out 182 is of rectangular shape and the other cut-out 183 is of an irregular shape to receive a good of similar shape. The cut-outs are each die cut to form tabs 184 that may be deflected inwardly when receiving a good (not shown).

In addition, the main section 177 has a pair of circular openings 185, each of which projects into a tab 184 on opposite sides of the cut-out 182 of rectangular shape while forming a semicircular recess that can be accessed by a finger.

Each extension 178-181 is sized to fold under the main section 177 to from sleeves. As viewed, each extension has four sections 186, 187,188,189 separated by fold lines 190 or other lines of weakening in order to be folded under the main section 177 to form a flattened sleeve. Each of these extensions 178-181 also has a pair of dust flaps 191 extending from the first and third sections 186, 188.

As illustrated, the four extensions 178-181 are of different sizes to form sleeves of different widths an done extension 179 is provided with a circular opening 185 in the first and second sections 186,187.

A pair of closure flaps 192 extends from each end of the main section 177. As illustrated, one closure flap 192 on the right-hand side of the main section 177 has a rectangular section 193 and a substantially rectangular end section 194. The other closure flap 192 on the right-hand side of the main section 177 has a rectangular section 195, a rounded end section 196 and a curved lateral section 197.

The closure flaps 192 on the left-hand side of the main section 177 are of the same shape as the closure flaps 192 on the opposite side but reversed. The rectangular section 193 of each closure flap 192 is sized to be equal to the height, as viewed, of the first section 186 of an adjacent extension 178-181.

Referring to FIGS. 31 and 32, in order to form the insert 175, the four extensions 178-181 are folded under and secured as by an adhesive to the main section 177 (as above) so that each extension 178-181 forms a sleeve with open ends. Thereafter, the dust flaps 191 of each extension 178-181 are folded perpendicularly across an opening of each sleeve followed by folding of the closure flaps 192 across the dust flaps 191 and insertion of the ends of the closure flaps 192 into the sleeves over the dust flaps 191 to impart a rectangular cross-section to each sleeve.

Referring to FIG. 30, after formation of the sleeves, the tabs 184 within the cut-outs 182, 183 of the main section 177 are deflected inwardly.

As illustrated, the first sections 186 of each extension 178-181 has an angled end facing the first section of an opposite extension to allow for flexing of the completed insert 175 in half.

Referring to FIG. 33, a good, such as a packet of razor blades 193 is inserted into the cut-out 182 of rectangular shape and held in place by the tabs 184. In addition, a razor 194 is inserted into the cut-out 183 of irregular shape and held in place by the tabs 184. The semicircular recesses on opposite sides of the rectangular cut-out 182 allow for ease of removal of the packet of razor blades 193. Likewise, the cut-out of irregular shape forms two semicircular recesses 195 on opposite sides of the cut-out 183 to facilitate removal of the razor 194.

After insertion of the packet of razor blades 193 and razor 194, the insert 195 may slid into an envelope as described in U.S. Pat. Nos. 6,227,444 and 9,352,879 for shipment through the mails or otherwise.

The embodiment of FIGS. 34 to 37 is directed to an insert 196 (FIG. 35) which is able to receive goods by being slid into sleeves of the insert.

Referring to FIG. 34, wherein like reference characters indicate like parts as above, the blank 197 for making the insert 196 has a main section 198 of rectangular shape and four extensions 199 extending from the main section 198.

The main section 198 has a vertical fold line 200 and a horizontal fold line 201 to facilitate flexing.

Three of the extensions 199 are identical and are sized to fold under the main section 198 to from sleeves. As viewed, each of these extensions 199 has four sections 202, 203, 204,205 separated by fold lines 206 or other lines of weakening in order to be folded under the main section 198 to form a sleeve of rectangular cross-section. Each of these extensions 199 also has a pair of dust flaps 206 extending from the first and third sections 202, 204 and an oval cut-out 207 centrally in the second section 203.

The fourth extension 199' is sized to fold under the main section and has four sections 202, 203, 204, 205 separated by fold lines 206 or other lines of weakening in order to be folded under the remainder of the main section 198 to form a sleeve of rectangular cross-section. This fourth extension 199' does not have dust flaps.

A pair of closure flaps 208 extends from one end of the main section 198 and a single closure flap 208 extends from the opposite end of the main section 198. As illustrated, each closure flap 208 has a rectangular section 209 and a substantially rectangular end section 210 defined by lines of weakening. The rectangular section 209 is sized to be equal to the height, as viewed, of the first section 202 of an adjacent extension 199.

In addition, each closure flap 208 has a pair of lock cuts 211 to prevent a closed sleeve end from opening in use.

Referring to FIGS. 36 and 37, in order to form the insert 196, the four extensions 199 are folded under and secured as by an adhesive to the main section 198 so that each extension 199 forms a sleeve with open ends. Thereafter, the dust flaps 206 of three extensions 199 are folded perpendicularly across an opening of each sleeve followed by folding of the three closure flaps 208 across the dust flaps 206 and insertion of the ends of the closure flaps 208 into the sleeves over the dust flaps 206 to impart a rectangular cross-section to each sleeve.

The insert 196 thus has three sleeves that are closed on one end and a fourth sleeve that is open at opposite ends.

Referring to FIG. 35, as above, the first sections 202 of the four extensions 199 have an angled end 74 facing the first sections of an opposed extension to allow for flexing of the completed insert in half.

The insert 196 is sized to receive goods within the sleeves and be slid into an envelope as described in U.S. Pat. Nos. 6,227,444 and 9,352,879 for shipment through the mails or otherwise.

In each embodiment, the insert is of a height and width to substantially fill the pocket of a paper mailer of standard or an expandable construction.

Alternatively, the insert and the item may be inserted in a sleeve, plastic bag, shrink-wrapped in plastic, or wrapped with a web of paper or plastic or the like to form the package for mailing purposes.

In another embodiment (not shown), the blank may be made in a similar manner to the blank of FIG. 34 with a main section of rectangular shape and a pair of extensions extending from each of two opposite sides of the main section.

As above, the main section has a vertical fold line and a horizontal fold line to facilitate flexing.

The extensions are identical and are sized to fold under the main section to from sleeves. Each extension has four sections separated by fold lines or other lines of weakening in order to be folded over (or under) the main section to form a sleeve of rectangular cross-section. When folded, the extensions form four sleeves that are spaced laterally from each other.

The extensions are not formed with dust flaps. Instead, a small strip is disposed along a lateral edge of each extension to extend over the first three foldable sections of the extension. In use, each strip is folded over the lateral edge of the respective extension to form a "ledge" extending along three sides of the opening into a foamed sleeve.

The blank also has a pair of closure flaps extending from each of other two opposite sides of the main section. Each closure flap of each pair is spaced laterally of the other to accommodate the spacing between the sleeves that are formed by the extensions.

Each closure flap has a substantially rectangular section extending from the main portion an amount equal to the height of the first section of an adjacent extension and a second substantially rectangular end section extending from the first section and being of slightly greater length, for example 9/16 inch versus ½ inch. These sections are separated by a line of weakening.

In use, after the extensions are folded to form the sleeves of an insert, each closure flap is pressed inward into the opening of a sleeve. At this time, the first section of a flap is pivoted about the main portion of the blank into the opening of a sleeve and the end section is pressed passed the "ledge" formed by the folded over strip to snap into place behind the "ledge". In this respect, the outer edges of the closure flaps curve inwardly slightly to further ease pressing of the flaps into a sleeve and may also assist in squaring up a sleeve.

The invention thus provides an insert or tray that is able to receive and retain rigid or non-rigid items within an envelope or wrapper to form a package that can be mailed as a flat-sized piece as defined by the USPS.

The invention also provides an insert or tray that has a uniform thickness, has flexibility and prevents shifting of contents.

The envelope and insert satisfies the USPS requirement that a flat-sized mail piece be uniformly thick so that any bumps, protrusions or other irregularities do not cause more than ¼" variance in thickness.

The invention also enables a shipper, for example of commercial goods, to mail an item in a manner that qualifies as a flat-sized piece postage in the United States.

What is claimed is:

1. A blank for a flexible insert for a flat-sized flexible envelope, said blank comprising a main section having a pair of substantially rectangular components and a fold line separating said rectangular components;

a first extension extending from one of said rectangular components, said extension having three sections, a first fold line between and separating an outermost section thereof from a middle section thereof, a first pair of parallel spaced apart fold lines between and separating said middle section from an innermost section thereof and a second pair of parallel spaced apart fold lines between and separating said innermost section from said one of said rectangular components;

a second extension extending from one side of the other of said rectangular components, said second extension having three sections, a first fold line between and separating an outermost section thereof from a middle section thereof, a first pair of parallel spaced apart fold lines between and separating said middle section from an innermost section thereof and a second pair of parallel spaced apart fold lines between and separating said innermost section from said other of said rectangular components; and a third extension extending from an opposite side of said other of said rectangular components from said second extension, said third extension having three sections, a first fold line between and separating an outermost section thereof from a middle section thereof, a first pair of parallel spaced apart fold lines between and separating said middle section from an innermost section thereof and a second pair of parallel spaced apart fold lines between and separating said innermost section from said one of said rectangular components.

2. A blank as set forth in claim 1 wherein said one of said rectangular components includes a rectangular opening.

3. A blank as set forth in claim 1 wherein each of said rectangular components has a pair of rounded corners on a side adjacent said first extension.

4. A blank as set forth in claim 1 made of corrugate.

5. A flexible insert for a flat-sized flexible envelope, said insert comprising a main section having a pair of substantially rectangular components and a fold line between said rectangular components;

a first spacer integral with one of said rectangular components and having three sections disposed in folded over relation to each other and in contact with said one of said rectangular components, a second spacer integral with the other of said rectangular components and having three sections disposed in folded over relation to each other and in contact with said other of said rectangular components, and a third spacer integral with said other of said rectangular components and having three sections disposed in folded over relation to each other and in contact with said other of said rectangular components in spaced relation to said second spacer.

6. An insert as set forth in claim 5 wherein said first spacer is on one side of the insert and said second spacer and said third spacer are on an opposite side of the insert.

7. An insert as set forth in claim 5 wherein said one of said rectangular components of said main section has a rectangular opening spaced from said first spacer.

8. An insert as set forth in claim 5 made of one-piece corrugate.

9. A blank for a flexible insert for a flat-sized flexible envelope, said blank comprising a main section having a pair of rectangular components and a fold line separating said rectangular components;

a first extension extending from one of said rectangular components, said extension having three sections, a first fold line between and separating an outermost section thereof from a middle section thereof, a second fold line between and separating said middle section from an innermost section thereof and a third fold line between and separating said innermost section from said one of said rectangular components;

a second extension extending from one side of the other of said rectangular components, said second extension having three sections, a first fold line between and separating an outermost section thereof from a middle section thereof, a second fold line between and separating said middle section from an innermost section thereof and a third fold line between and separating said innermost section from said other of said rectangular components; and a third extension extending from an opposite side of said other of said rectangular components from said second extension, said third extension having three sections, a first fold line between and separating an outermost section thereof from a middle section thereof, a second fold line between and separating said middle section from an innermost section thereof and a third fold line between and separating said innermost section from said one of said rectangular components.

10. A blank as set forth in claim 9 wherein said outermost section of each of said first extension, second extension and said third extension has a tab extending laterally thereof and a fold line separating said tab from said outermost section of each said respective extension.

11. A blank as set forth in claim 9 wherein said middle section of each of said first extension, second extension and said third extension is rectangular.

12. A blank as set forth in claim 9 wherein said innermost section of each of said first extension, second extension and said third extension has a tab extending laterally thereof, a first fold line separating said tab from said innermost section of each said respective extension, a rounded gusset extending laterally of said innermost section opposite said tab and a second fold line separating said rounded gusset from said innermost section of each said respective extension.

13. A blank as set forth in claim 9 further comprising an opening in said one of said rectangular components, a first flap extending from said one of said rectangular components for folding over said one of said rectangular components in spaced relation to said opening, and a pair of spaced apart flaps extending from said other of said rectangular components for folding over said other of said rectangular components.

14. A blank as set forth in claim 9 made of one-piece paperboard.

15. A flexible insert for a flat-sized flexible envelope, said insert comprising a flat main section; and at least three spacers integral with and overlying said main section, at least one of said spacers having a first section extending from said main section in perpendicular relation thereto, a second section extending from said first section in parallel to said main section, a third section extending from said second section in perpendicular relation to said main section and a fourth section extending from said third section and secured to said main section.

16. A blank for forming a flexible insert for a flat-sized flexible envelope, said blank comprising a main section of rectangular shape;

a plurality of extensions extending from said main section, each said extension having a plurality of sections for folding into a sleeve of rectangular cross-section on said main section;

a pair of dust flaps on at least one of said extensions for folding across a respective sleeve;

a closure flap extending from said main section for folding across said dust flaps, said closure flap having an end section for insertion into said respective sleeve to close said respective sleeve.

17. A blank as set forth in claim 16 further comprising at least one cut-out in said main section having die cuts to form tabs.

18. A blank as set forth in claim 16 further comprising three rectangular cut-outs with tabs in said main section to receive goods and an oval cut-out in said main section for viewing contents in a sleeve under said oval cut-out.

19. A blank as set forth in claim 16 further comprising a rectangular cut-out with tabs in said main section and an irregularly shaped cut-out in said main section.

20. A flexible insert for a flat-sized flexible envelope, said insert comprising a flat main section; and at least three sleeves integral with and overlying said main section, at least one of said sleeves having a first section extending from said main section in perpendicular relation thereto, a second section extending from said first section in parallel to said main section, a third section extending from said second section in perpendicular relation to said main section and a fourth section extending from said third section and secured to said main section; and at least one closure flap extending from said main section for folding across an end of a respective sleeve of said three sleeves, said closure flap having an end section for insertion into said respective sleeve to close said respective sleeve.

21. A blank for forming a flexible insert for a flat-sized flexible envelope said blank comprising a main section of rectangular shape; and a pair of spaced apart extensions extending from each of two opposite sides of said main section, each said extension having a plurality of sections for folding into a sleeve of rectangular cross-section on said main section.

22. A blank as set forth in claim 21 wherein each said extension has a first section extending from said main section with a triangular portion facing an opposite extension to create a space between opposed sleeves and form a V-shaped gap therebetween to allow for flexing of the insert.

23. A flexible insert for shipping goods in a flat-sized flexible envelope, said insert comprising a flat main section; and a pair of sleeves on each of two opposite sides of said main section integral with and overlying said main section for receiving goods therein, each said sleeve having a first section extending from said main section in perpendicular relation thereto, a second section extending from said first section in parallel to said main section, a third section extending from said second section in perpendicular relation to said main section and a fourth section extending from said third section and secured to said main section.

24. An insert as set forth in claim 23 where at least one sleeve of said plurality of sleeves has an opening in said second section thereof to provide visual access to the goods therein.

25. An insert as set forth in claim 23 wherein at least one sleeve of said plurality of sleeves has a dust flap extending from said first section thereof and disposed in said one sleeve and a closure flap extending from said second main section thereof and disposed over said dust flap to close an end of said one sleeve.

* * * * *